US008181811B1

(12) United States Patent
Blake

(10) Patent No.: US 8,181,811 B1
(45) Date of Patent: May 22, 2012

(54) THERMALLY INSULATED CONTAINER

(76) Inventor: Michael N. Blake, Tampa, FL (US)

( * ) Notice: Subject to any disclaimer, the term of this patent is extended or adjusted under 35 U.S.C. 154(b) by 592 days.

(21) Appl. No.: 12/319,465

(22) Filed: Jan. 7, 2009

Related U.S. Application Data

(60) Provisional application No. 61/069,371, filed on Mar. 14, 2008.

(51) Int. Cl.
*B65D 25/22* (2006.01)

(52) U.S. Cl. ..... 220/475; 248/156

(58) Field of Classification Search ..... 220/600, 220/17.1; D9/455; 211/62; *B65D 25/22, B65D 25/24, 25/28*
See application file for complete search history.

(56) References Cited

U.S. PATENT DOCUMENTS

| | | | | | |
|---|---|---|---|---|---|
| 1,328,826 | A | * | 1/1920 | Eberle | 248/166 |
| 1,801,055 | A | * | 4/1931 | Roos | 220/629 |
| 2,573,412 | A | * | 10/1951 | Diefendorf, Jr. | 312/240 |
| 2,663,391 | A | | 12/1953 | Kuhns | |
| 2,673,053 | A | * | 3/1954 | Kilian | 248/153 |
| 4,741,321 | A | * | 5/1988 | Squires | 126/9 R |
| D302,922 | S | | 8/1989 | Carlson | |
| 4,913,713 | A | | 4/1990 | Bender et al. | |
| 5,269,157 | A | | 12/1993 | Ciminelli et al. | |
| 5,325,990 | A | * | 7/1994 | Temple | 220/628 |
| 5,465,988 | A | | 11/1995 | Dennis | |
| 5,778,953 | A | * | 7/1998 | Braddock | 144/286.1 |
| D421,696 | S | | 3/2000 | Hendrix | |
| 6,070,718 | A | | 6/2000 | Drabwell | |
| 6,199,570 | B1 | | 3/2001 | Patarra | |
| 6,216,488 | B1 | | 4/2001 | Rucker | |
| D448,625 | S | | 10/2001 | Moffett, III | |
| 6,374,839 | B2 | | 4/2002 | Patarra | |
| 6,474,097 | B2 | | 11/2002 | Treppedi et al. | |
| 6,536,733 | B1 | | 3/2003 | Sharp | |
| 6,554,012 | B2 | | 4/2003 | Patarra | |
| 6,588,720 | B1 | | 7/2003 | Revette | |
| D479,440 | S | | 9/2003 | Kennedy | |
| 6,796,319 | B1 | | 9/2004 | Patarra et al. | |
| 6,814,333 | B1 | | 11/2004 | Freiburger | |
| 6,895,982 | B1 | | 5/2005 | Shaw | |
| 6,993,931 | B1 | | 2/2006 | Hamilton | |
| 7,143,601 | B1 | | 12/2006 | Jimenez | |
| 7,163,262 | B2 | | 1/2007 | Anglin | |
| 2001/0006073 | A1 | | 7/2001 | Patarra | |
| 2001/0054433 | A1 | | 12/2001 | Patarra | |

(Continued)

OTHER PUBLICATIONS

U.S. Appl. No. 29/301,732, M. N. Blake.

*Primary Examiner* — Mickey Yu
*Assistant Examiner* — Robert J Hicks
(74) *Attorney, Agent, or Firm* — Frijouf, Rust & Pyle, P.A.

(57) ABSTRACT

A thermally insulated container is disclosed for maintaining thermo energy of an object. A first anchor is pivotably secured to the container and pivots to a position below the container for engaging a soil layer and preventing rotation of the container relative to a ground surface. A first locking arm extends between the container and the first anchor for locking the first anchor relative to the container. A second anchor is pivotably secured to the container and pivots to a position below the container for engaging a soil layer and preventing rotation of the container relative to the ground surface. A second locking arm extends between the container and the second anchor for locking the second anchor relative to the container.

15 Claims, 9 Drawing Sheets

U.S. PATENT DOCUMENTS

2003/0136886 A1* 7/2003 Zhu ..... 248/129
2003/0150964 A1* 8/2003 Sherer et al. ..... 248/146
2005/0279750 A1* 12/2005 Barquist et al. ..... 220/629
2006/0202092 A1 9/2006 Johnson
2006/0283883 A1* 12/2006 Mika et al. ..... 222/129
2007/0152003 A1 7/2007 Dollar, Jr.
2007/0154276 A1 7/2007 Dollar, Jr.
2009/0095762 A1* 4/2009 Jung et al. ..... 220/669

* cited by examiner

THERMALLY INSULATED CONTAINER

CROSS-REFERENCE TO RELATED APPLICATIONS

This application claims benefit of U.S. Patent Provisional application Ser. No. 61/069,371 filed Mar. 14, 2008. All subject matter set forth in provisional application Ser. No. 61/069,371 is hereby incorporated by reference into the present application as if fully set forth herein.

BACKGROUND OF THE INVENTION

1. Field of the Invention

This invention relates to containers and more particularly to the thermally insulated containers.

2. Background of the Invention

In order for an individual to transport one or more articles a portable container may be utilized. Since an individual is only capable of lifting and carrying a limited weight, the weight of the portable container is significant. In addition, the carrying mechanism utilized with the portable container can greatly increase both the weight capacity of the portable container and the efficiently of the individual to lift and carry the portable container. More importantly footing of the portable container is crucial for resisting overturning that result in the contents of the portable container to be ejected from the portable container. Finally, it may be desirable to utilize the portable container as a base for attachment of various items.

Various types of portable container have been proposed by the prior art for transporting one or more articles. The following U.S. Patents are examples of attempt of the prior art to solve these problems.

U.S. Pat. No. 2,663,391 to Kuhns discloses a container having a bottom, side, end walls and a pair of panels having side flanges. The flanges are pivoted to the end walls adjacent the top of the container thereby permitting the panels to extend from the sides of the container in alignment with the top thereof. Rigid U-shaped members pivot to the end walls adjacent the bottom of the container. Members each have outwardly offset portions serving in one position to converge together as handle means and in another position to diverge apart as container supporting means. Locking members pivot to the side walls adjacent the bottom of the container. Locking members have portions adapted to embrace the U-shaped members adjacent their respective pivot ends when the U-shaped members are in container supporting position with the offset portion in diverged apart position upon a supporting surface.

U.S. Pat. No. 4,913,713 to R. S. Bender et al. discloses a countertop cooler for standard size water bottles where the plastic bottle has a spigot at the lower front end of said bottle which allows withdrawal of water. The water bottle enclosed in a refrigeration case for cooling. The refrigeration case has a removable top in which the bottle and removable top section of the cooler is held in place by a means for securing the removable section in place to close the refrigeration case. Within the refrigeration case is a metal conductive cooling surface member extending from the rear of the case extending along at least a substantial portion of the bottom and sides of the refrigeration case. Cooling the water bottle by conduction with a cooling means preferably thermoelectric incorporated within the cooler and in engagement with the metal cooling surface member. The cooler preferably has foldable or extendable legs for selectively permitting the mounting of the cooler under kitchen cabinets, or raised for easier filling of tall receptacles.

U.S. Pat. No. 5,269,157 to Ciminelli et al. discloses an insulated beach box in which ice, beverages and various other food products may be placed with the ice maintaining the beverages and food products at a cold and fresh condition even though the beach box is placed on the beach where it may be relatively hot. The beach box includes structural features and attachments which enables the box to be effectively used as a beach chair having a seat back pivotally connected thereto which forms a pull handle when oriented generally in perpendicular relation to the top of the box which forms a seat. The box includes wheels and a rounded corner surface generally in alignment with the seat back which enables the device to be easily pulled over a hard surface by using the wheels and over sand by using the curved corner and adjacent surfaces of the box to facilitate the beach box being pulled to a desired site. The seat back includes pockets for storage of various items and is pivotally supported from the box to enable the seat back to be pivoted forwardly to a generally horizontal position to enable the beach box to be carried by the use of end handles or stored. The seat back also provides an effective support for an optional umbrella which can be detachable clamped thereto and enables various other items that may be carried to or from the beach to be supported by placing them against the upper surface of the seat and the front surface of the seat back with such items being strapped in position if desired.

U.S. Pat. No. 5,465,988 to Dennis discloses an utility cart which includes in a first preferred embodiment, a cart frame fitted with a pair of fixed rear wheels and a single, steerable front wheel and further including a divided ice chest with a hinged lid and a storage compartment lying adjacent to the ice chest. Removable chair supports are upward-standing from the storage compartment for stacking one or more folded lawn chairs or the like and to provide a location for hanging a trash bag. Four tables are hinged to the cart frame in drop-leaf fashion for selected horizontal extension and support. A pair of vertical umbrella brackets receive an umbrella support to shade the table tops. In another preferred embodiment of the invention the cart frame includes a receptacle for receiving an ice chest specifically designed for the purpose or a conventional ice chest, and in both embodiments of the invention a telescoping handle facilitates towing of the utility cart and positioning the utility cart in a desired location. In a most preferred embodiment of the invention the utility carts components, including the table top lids and chair storage supports, are constructed of expanded foam insulation sandwiched between plastic sheets.

U.S. Pat. No. 6,070,718 to D. A. Drabwell discloses an insulated container system for facilitating storage of items with minimal temperature change over time. The insulated container system includes a container of insulated material having a removable lid stabilized by magnets, a table top stabilized by magnets, and a compartmented removable insulating insert generally conforming to an interior shape of the container. The compartments of the insert are designed for retaining hot or cold packs within the main compartment. Additional side compartments and a storage drawer are provided. The table top is foldable for storage between brackets on the main compartment. It is most preferred that the container include a flared bottom portion for preventing tippage of the container.

U.S. Pat. No. 6,199,570 to Patarra discloses the combination of an umbrella and cooler or carrier vessel comprising a main mast, a flexible umbrella frame operatively arranged at one end of the mast, means to maintain the flexible frame of the umbrella in spaced apart stand-off relation with respect to the main mast when the umbrella is collapsed and lowered, a vessel arranged at the opposite end of the mast and surrounding it, the distance of the side walls of the vessel from the mast and the distance at which the flexible frame of the umbrella is maintained from the mast by the spacing stand-off means being approximately equal to permit the flexible umbrella frame to surround the vessel.

U.S. Pat. No. 6,216,488 to Rucker discloses a thermally insulated cooler is provided which presents multiple storage compartments for hot or cold food and beverages, an umbrella holder, and allows for translation of the cooler over a surface. Additionally, the thermally insulated cooler and storage device may also be used as a dolly to transport larger beach wares such as folding chairs and play toys. A centrally located umbrella holder is also provided along with audio speakers and a stereo receiver that may be removed from the thermally insulated cooler. Accordingly, the thermally insulated cooler provides storage and transportation of beach, camping or similar gear.

U.S. Pat. No. 6,374,839 to Patarra discloses a container apparatus for use in combination with an umbrella having an umbrella mast and umbrella canopy includes a food container having a container top wall, a container side wall and a container bottom wall together defining a container interior, with an umbrella mast passing port, a mast engaging structure, and a container interior access door; so that the umbrella mast of may be inserted into the mast passing port and advanced into the interior of the container and engaged by the mast engaging structure, thereby holding the umbrella mast upright relative to the container and so that the container stabilizes the umbrella, which can be opened over the container. The container preferably is insulated against heat transfer between the container interior and the surrounding environment and the container top wall preferably is substantially horizontal when the container is upright and thereby functions as a table upon which a user can place food and drink items. The apparatus preferably additionally includes a pull handle on the container and at least one wheel rotatably mounted onto the container substantially opposite the pull handle so that the container wheel rolls on the ground as the pull handle is pulled by a user. The apparatus preferably still further includes a container stabilizing mechanism for keeping the umbrella from overbalancing the container and causing the container to tip over when the apparatus rests on a granular surface.

U.S. Pat. No. 6,474,097 to Treppedi et al. discloses an insulated cooler having ski runners and wheels in combination for mobility for attachment to the underside of the cooler body. The cooler also has the interior partition to form a thermos container portion and an ice cooler portion. A removable thermos with cap and pump spout are disclosed which pump spout extends through a recess in one sidewall of the cooler body. Molded compartments are located on the underside, of the cooler lid for storage of various items. Cargo netting is attached to the side of the cooler with snap ring ports which also can hold various items. The underside of the cooler contains recessed wheel wells for receiving the wheels which are attached with retaining pins into mounting holes on the underside of the cooler body. Also disclosed is a umbrella retainer bracket for holding an umbrella shaft using a retaining knob in such a way that the point of the umbrella can be inserted into the sand or ground so as to hold the present invention in a stable position.

U.S. Pat. No. 6,536,733 to Sharp discloses a cooler (ice chest) with an integrated umbrella stand. A cooler serves as the base of an umbrella stand. A receptacle for the umbrella pole is provided on a side of the cooler. In one embodiment, the receptacle includes two hinged rings. In another embodiment, the receptacle is molded into a recess in the side of the cooler. In an alternative embodiment, a conventional cooler is converted to an umbrella stand by applying hinged rings to the side of the cooler. In a preferred embodiment, the hinged rings are die-cut from a sheet of material as a single piece and attached to the cooler with an adhesive.

U.S. Pat. No. 6,554,012 to Patarra discloses a container apparatus for use in combination with an umbrella having an umbrella mast and umbrella canopy includes a food container having a container top wall, a container side wall and a container bottom wall together defining a container interior, with an umbrella mast passing port, a mast engaging structure, and a container interior access door; so that the umbrella mast of may be inserted into the mast passing port and advanced into the interior of the container and engaged by the mast engaging structure, thereby holding the umbrella mast upright relative to the container and so that the container stabilizes the umbrella, which can be opened over the container.

U.S. Pat. No. 6,588,720 to P. Revette discloses a holder for a portable water cooler, which holder is designed to be mounted onto the inside of the side of a bed of a pickup truck. The water cooler holder has a cylindrical container-like member which securely holds the water cooler therein which member is mounted onto a frame which pivots from a first downward position to a second upward position so that the water cooler can be accessed from the outside of the bed of the pickup.

U.S. Pat. No. 6,796,319 to Patarra et al. discloses a portable cooler having wheels at one end, a pop-up tray table on top and an umbrella stand located at the wheeled end of the cooler.

U.S. Pat. No. 6,814,333 to D. J. Freiburger discloses a portable cooler stand having a collapsed or folded configuration for transportation and an unfolded configuration for supporting cooler off the ground within easy reach of users. The stand has four support legs. The legs are positionable roughly at the corners of a rectangle, with each support leg is linked to two adjacent support legs by a pair of folding positioning members. Two parallel load bars are pivotally connected to two adjacent support legs and may be extended to attach temporarily to the remaining two support legs to fix the length of the support cooler in its unfolded condition. One or more flexible belts are connected between the load bars to support a cooler or similar bulky object between the load bars. Under the weight of the cooler the load bars move toward one another until they contact the cooler, which fixes the width of the stand and completes the structure's rigidity.

U.S. Pat. No. 6,895,982 to Shaw discloses a carrying bucket that can be converted to a support stand for an umbrella. A 5 and ½ gallon bucket having a rotatable handle can be used to carry supplies such as towels, food and beverages from one remote location such as an automobile parking lot to a beach location. At the beach location, the bucket is placed on a ground surface where an umbrella stand can be attached to the bucket so that the bucket functions as an above ground ballast anchor to support the umbrella in an upright position.

U.S. Pat. No. 6,993,931 to Hamilton discloses a portable cooler and adjustable chair has a body, wheels, an insulating layer traveling about a perimeter of the body, a tray slidably positioned within the cavity, and a housing secured to the body for receiving a bottom portion of an umbrella. A foldable chair is slidably positioned on top of the body and can be folded between raised and lowered positions. A lid is provided adjacent the chair for allowing a user to access foodstuff disposed within the body cavity. Also, a handle is provided so that a user can readily transport the cooler by pivot same about the wheels applying motive force in a desired direction.

U.S. Pat. No. 7,143,601 to Jimenez discloses a cooler a standard piece of recreational equipment. This device combines the utility of a cooler with an umbrella, a radio, speakers, and a bottle opener. Because this device combines all three functions in one device the consumer is not required to purchase or carry each item separately. A handle and wheels have been installed on this device to allow the user an easy way to transport this device.

U.S. Pat. No. 7,163,262 to Anglin discloses a cooler seat. The seat has a seat back assembly and seat bottom assembly that provide comfortable seating and are collapsibly attached to a cooler container. The seat further includes a retractable awning for sun and rain protection. The seat bottom assembly further includes retractable footrests and clips for attaching to the tailgate of the conventional pickup truck. The seat is also configured to unfold and fit in the open end of a conventional pickup truck bed.

U.S. Pat. D302,922 to A. R. Carlson discloses an ornamental design for a insulated portable unit, as shown and described.

U.S. Pat. D421,696 to L. A. Hendrix discloses an ornamental design for a beverage cooler, as shown and described.

U.S. Pat. D448,625 to N. Moffett, III et al. discloses an ornamental design for a folding stand cooler, as shown and described.

U.S. Pat. D479,440 to Kennedy discloses an ornamental design for a dual sided cooler with umbrella, as shown and described.

U.S. Patent Application 2001/0006073 to Patarra discloses a container apparatus for use in combination with an umbrella having an umbrella mast and umbrella canopy includes a food container having a container top wall, a container side wall and a container bottom wall together defining a container interior, with an umbrella mast passing port, a mast engaging structure, and a container interior access door; so that the umbrella mast of may be inserted into the mast passing port and advanced into the interior of the container and engaged by the mast engaging structure, thereby holding the umbrella mast upright relative to the container and so that the container stabilizes the umbrella, which can be opened over the container. The container preferably is insulated against heat transfer between the container interior and the surrounding environment and the container top wall preferably is substantially horizontal when the container is upright and thereby functions as a table upon which a user can place food and drink items. The apparatus preferably additionally includes a pull handle on the container and at least one wheel rotatably mounted onto the container substantially opposite the pull handle so that the container wheel rolls on the ground as the pull handle is pulled by a user. The apparatus preferably still further includes a container stabilizing mechanism for keeping the umbrella from overbalancing the container and causing the container to tip over when the apparatus rests on a granular surface.

U.S. Patent Application 2001/0054433 to Patarra discloses a container apparatus for use in combination with an umbrella having an umbrella mast and umbrella canopy includes a food container having a container top wall, a container side wall and a container bottom wall together defining a container interior, with an umbrella mast passing port, a mast engaging structure, and a container interior access door; so that the umbrella mast of may be inserted into the mast passing port and advanced into the interior of the container and engaged by the mast engaging structure, thereby holding the umbrella mast upright relative to the container and so that the container stabilizes the umbrella, which can be opened over the container.

U.S. Patent Application 2006/0202092 to S. E. Johnson discloses a stand for a cooler containing cooling solution. The cooler further includes an attached flexible tubing outlet for draining the cooling solution through the flexible tube outlet into a medical cuff for reducing swelling of injured tissue. The stand further comprises a cylindrical container having a bottom side, a lateral sidewall, a bottom sidewall. The lateral sidewall is further defined by an opened top edge and a bottom edge. The bottom sidewall is further defined by a top edge and a bottom edge. The bottom edge of the bottom sidewall is attached to the bottom side. The bottom edge of the lateral sidewall is attached to the top edge of the bottom sidewall, wherein a cavity is formed for receiving through the opened top end of the lateral sidewall the cooler. An elongated pedestal is further defined by a top end and a bottom end. The top end of the pedestal is attached underneath the bottom side of the container. A base is medially attached in a perpendicular relation to the bottom end of the pedestal, wherein the container is supported in an upright position a distance above the surface of the ground. An aperture is located in the lateral side wall for receiving the flexible tubing outlet therethrough.

U.S. Patent Application 2007/0152003 to R. L. Dollar, Jr. discloses a swingout portable beverage cooler caddy for use in vehicles equipped with a cargo area is comprised of a carriage assembly capable of supporting the weight of a filled cooler, a pivotable stanchion to which the carnage assembly is attached, mounting means for securing the carriage assembly to the interior surface of the cargo area, and locking means for securing the carriage assembly in place during stowage of the cooler within the cargo area. The subject apparatus provides a means for easily rotating the cooler from a stowage position inside the cargo area to an easily accessible position at the edge of or outside the cargo area such as overtop a lowered tailgate. The subject apparatus further restricts movement of the cooler preventing it from tipping over during operation of the vehicle.

U.S. Patent Application 2007/0154276 to R. L. Dollar, Jr. discloses a portable beverage cooler retention device for use in vehicles equipped with a fold-down tailgate is comprised of a pair of triangular uprights pivotally attached to the inside wall of a tailgate by a pair of transverse mounting plates; the uprights including locking means for maintaining their perpendicular orientation relative to the planar surface of the tailgate during use and further including container support means for the pendulous support of a cooler there between. When properly seated in the cooler mounting means, the subject portable beverage cooler retention apparatus provides a means for 1) automatically moving the cooler from the cargo area (when the tailgate is closed) to an easily accessible position above the tailgate (when the tailgate is lowered to its open position); and 2) restricting movement of the cooler within the cargo area during transport.

Although the aforementioned prior art have contributed to the development of the art of portable container, none of these prior art patents have solved the needs of this art.

Therefore, it is an object of the present invention to provide an improved portable container.

Another object of this invention is to provide an improved portable container that resists overturning.

Another object of this invention is to provide an improved portable container that will support an umbrella.

Another object of this invention is to provide an improved portable container that be easily transported by an individual.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a thermally insulated container for maintaining the thermo energy of an object. The thermally insulated container positioned over a ground surface. The ground surface covers a soil layer. The thermally insulated container comprises a bottom wall, a first side wall, a second side wall, a third side wall and a fourth side wall for defining a container. The container defines a cavity for housing the object and an aperture for positioning the object within the cavity. A cover plate engages the aperture for covering the cavity. A first anchor is pivotably secured to the first side wall and pivots from the first side wall to a position below the bottom wall for preventing rotation of container relative to the ground surface. The first anchor includes a first pivot arm and a second pivot arm. A first plate extends between the first pivot arm and the second pivot arm for engaging the soil layer. A first locking arm extends between the first side wall and the first anchor for locking the first anchor relative to the first side wall. A second anchor is pivotably secured to the second side wall and pivoting from the second side wall to a position below the bottom wall for preventing rotation of container relative to the ground surface. The second anchor includes a first pivot arm and a second pivot arm. A second plate extends between the first pivot arm and the second pivot arm for engaging the soil layer. A second locking arm extends between the second side wall and the second anchor for locking the second anchor relative to the second side wall.

In one embodiment of the invention, a cylinder has a bore extending from the bottom wall and into the cavity. A shaft has a base end and a terminal end. The base end of the shaft engages the bore of the cylinder for securing the shaft to the container. An umbrella has a receiver and a canopy. The receiver of the umbrella engages the terminal end of the shaft. The first anchor and the second anchor prevent rotation of umbrella relative to the ground surface.

In a more specific embodiment of the invention, said first anchor including a first lock receiver and a second lock receiver. The first lock receiver of the first anchor engages the first locking arm for positioning the first anchor at a first angle relative to the container. The second lock receiver of the first anchor engages the first locking arm for positioning the first anchor at a second angle relative to the container. The second anchor includes a first lock receiver and a second lock receiver. The first lock receiver of the second anchor engages the second locking arm for positioning the second anchor at a first angle relative to the container. The second lock receiver of the second anchor engaging the second locking arm for positioning the second anchor at a second angle relative to the container.

In another embodiment of the invention, the first side wall includes a first taper positioned adjacent to the bottom wall for increasing contact between the first side wall and the ground surface. The first taper includes a first bore for receiving a first stake. The second side wall includes a second taper positioned adjacent to the bottom wall for increasing contact between the second side wall and the ground surface. The second taper including a second bore for receiving a second stake. The third side wall including a third taper positioned adjacent to the bottom wall for increasing contact between the third side wall and the ground surface. The third taper including a third bore for receiving a third stake. The fourth side wall including a fourth taper positioned adjacent to the bottom wall for increasing contact between the fourth side wall and the ground surface. The fourth taper including a fourth bore for receiving a fourth stake. The first taper, the second taper, the third taper and the fourth taper prevent rotation of container relative to the ground surface. The first stake, the second stake, the third stake and the fourth stake engage the soil layer for preventing rotation of container relative to the ground surface.

In a more specific embodiment of the invention, the first anchor includes a first locking pin and a second locking pin. The first side wall includes a first anchor recess for housing the first anchor within the first side wall. The first anchor recess includes a first locking pin receiver and a second locking pin receiver. The first locking pin receiver and the second locking pin receiver of the first anchor recess engages the first locking pin and the second locking pin of the first anchor respectively for pivoting the first anchor within the first anchor recess. The second anchor includes a first locking pin and a second locking pin. The second side wall includes a second anchor recess for housing the second anchor within the second side wall. The second anchor recess includes a first locking pin receiver and a second locking pin receiver. The first locking pin receiver and the second locking pin receiver of the second anchor recess engages the first locking pin and the second locking pin of the second anchor respectively for pivoting the second anchor within the second anchor recess.

In a more specific embodiment of the invention, the first locking arm includes a first locking pin and a second locking pin. The first side wall includes a first locking arm recess for housing the first locking arm within the first side wall. The first locking arm recess includes a first locking pin receiver and a second locking pin receiver. The first locking pin receiver and the second locking pin receiver of the first locking arm recess engages the first locking pin and the second locking pin of the first locking arm respectively for pivoting the first locking arm within the first locking arm recess. The second locking arm includes a first locking pin and a second locking pin. The second side wall including a second locking arm recess for housing the second locking arm within the second side wall. The second locking arm recess includes a first locking pin receiver and a second locking pin receiver. The first locking pin receiver and the second locking pin receiver of the second locking arm recess engages the first locking pin and the second locking pin of the second locking arm respectively for pivoting the second locking arm within the second locking arm recess.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
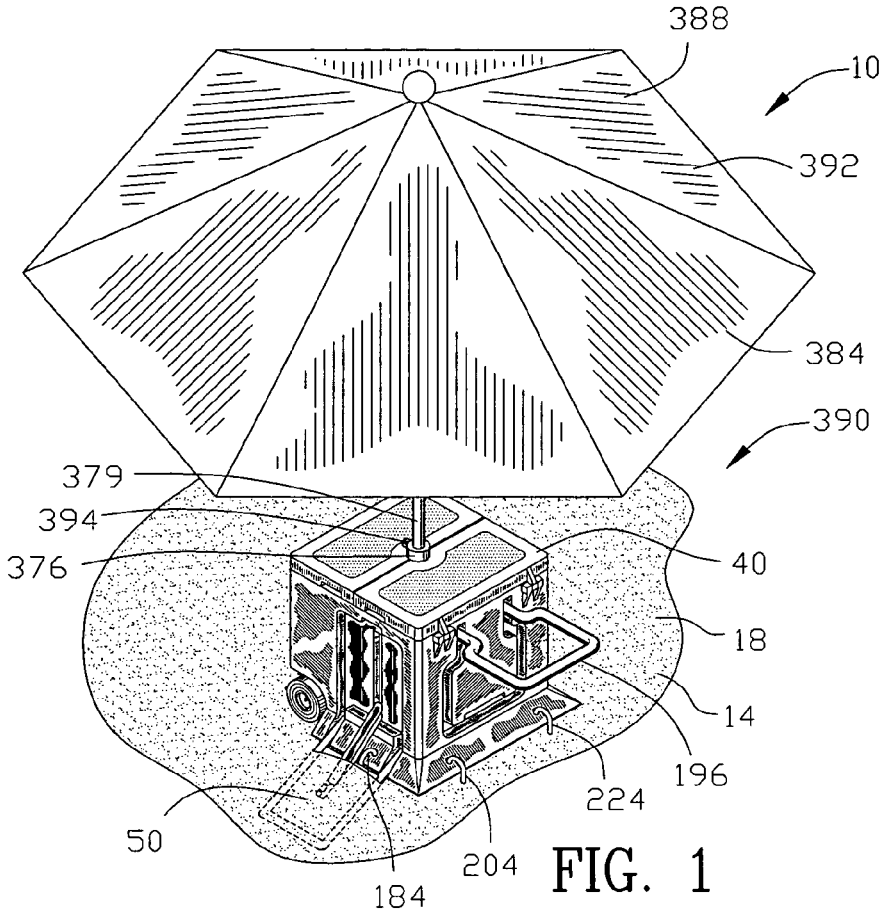
FIG. 1 is an isometric view of a thermally insulated container for maintaining the thermo energy of an object incorporating the present invention.
Figure 2:
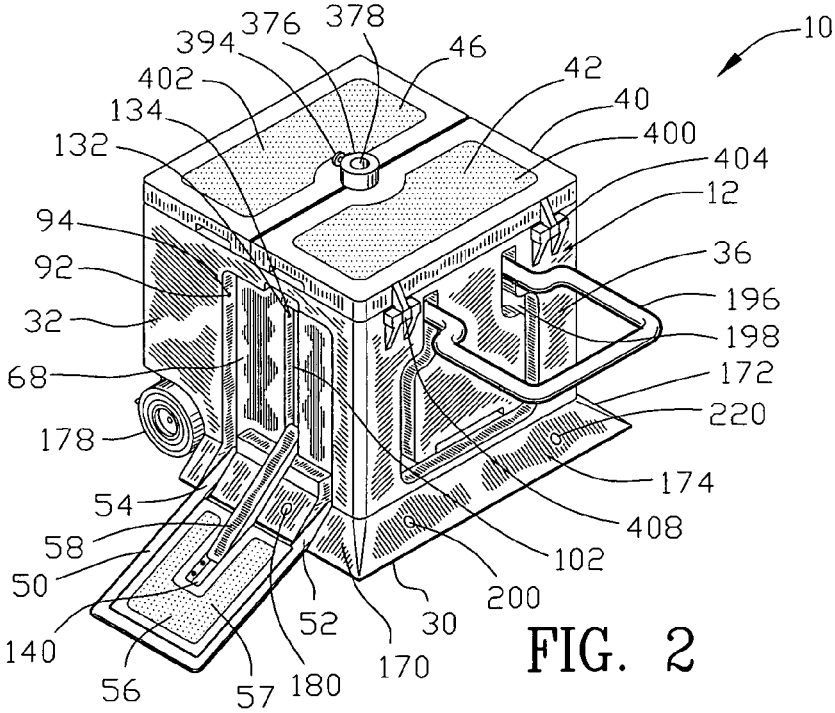
FIG. 2 is a magnified view of a portion of FIG. 1.
Figure 3:
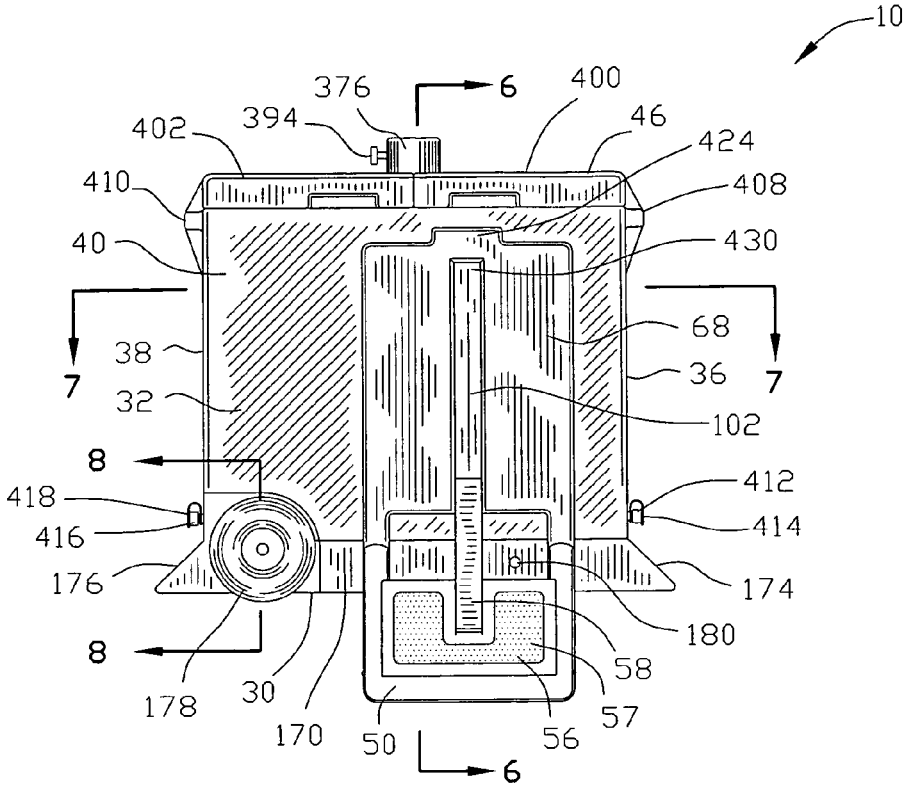
FIG. 3 is a side view of FIG. 2.
Figure 4:
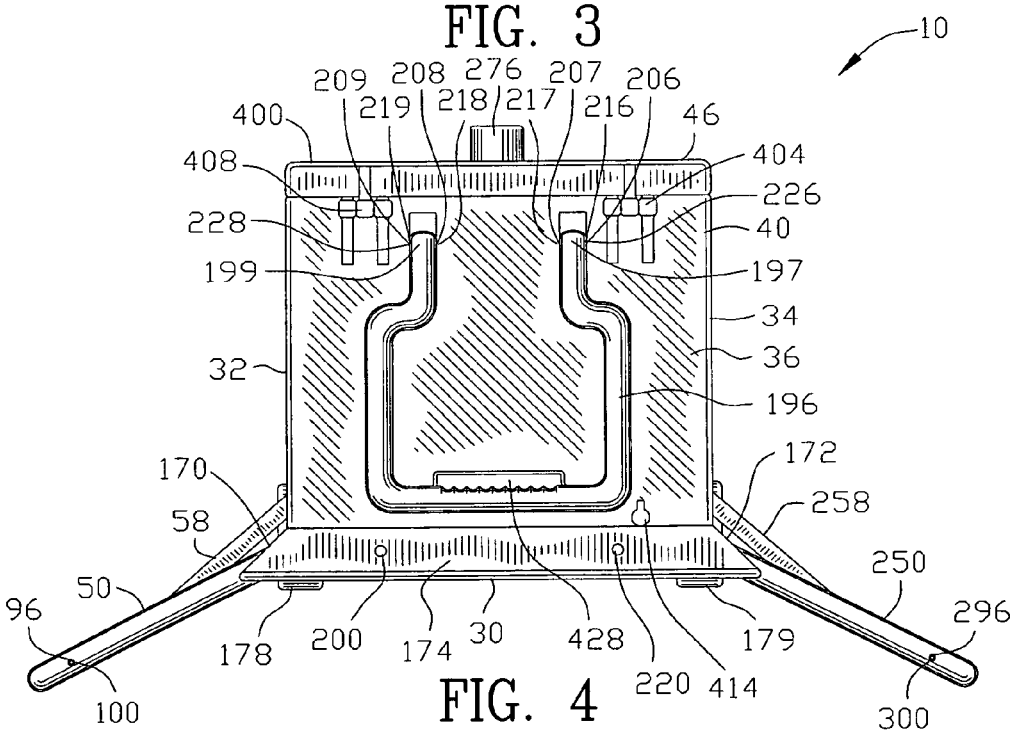
FIG. 4 is a front view of FIG. 2.
Figure 5:
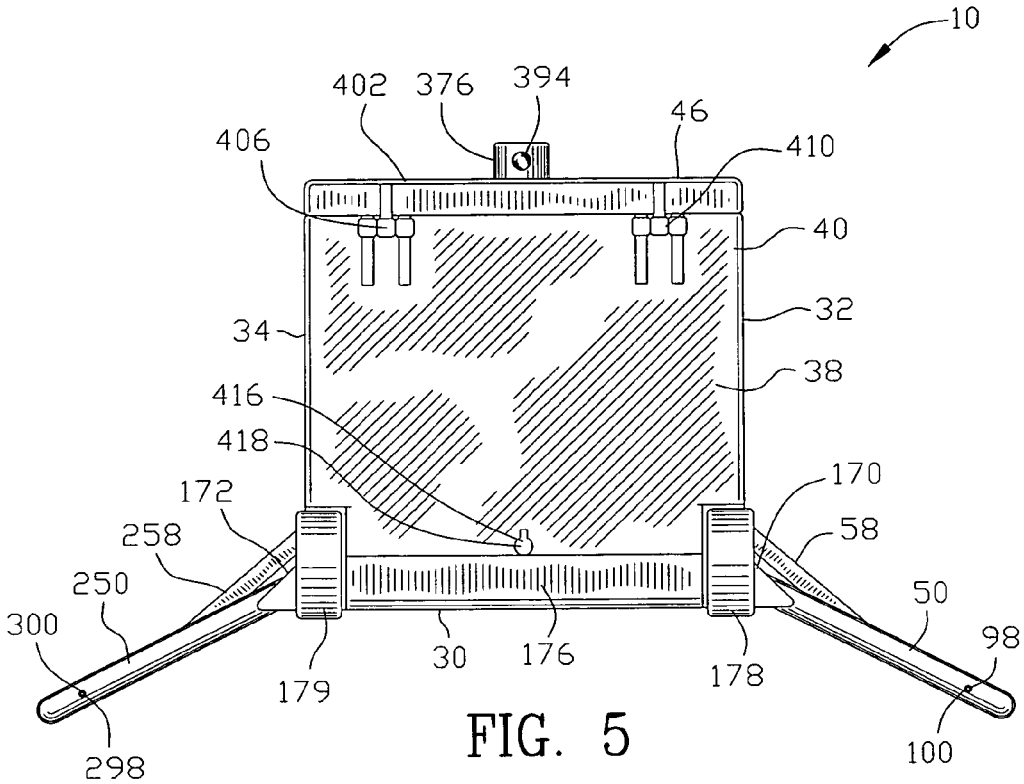
FIG. 5 is a rear view of FIG. 2.
Figure 6:
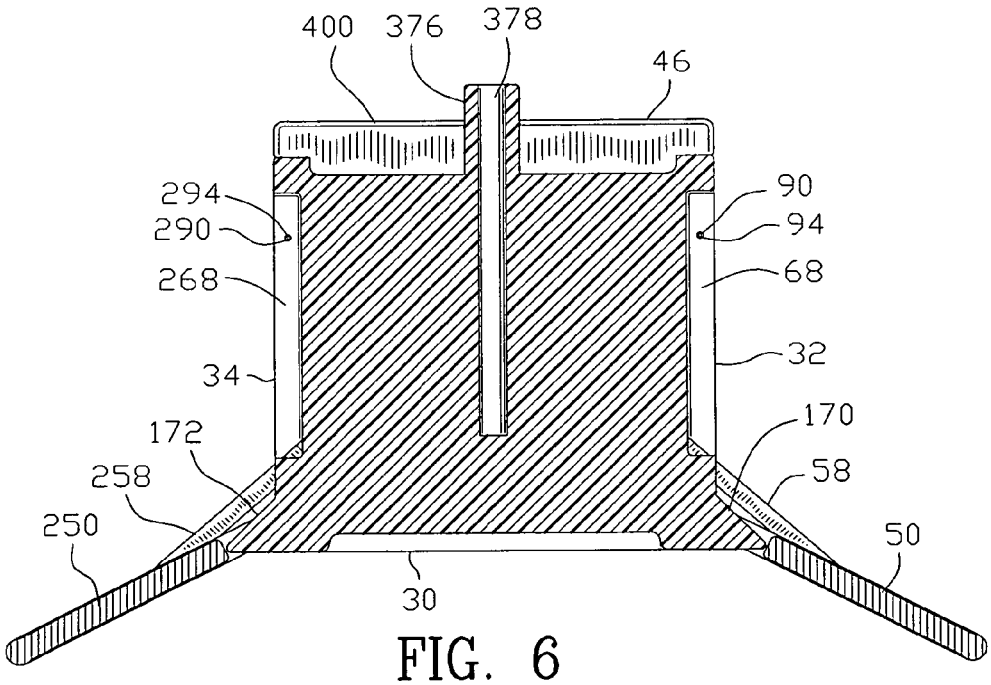
FIG. 6 is a sectional view along line 6-6 in FIG. 3.

FIGS. 1-29 are various views of a thermally insulated container 10 for maintaining the thermo energy of an object 12. The thermo storage device 10 is positioned over a ground surface 14. The ground surface 14 covers a soil layer 16. The ground surface 14 is shown to be a sand surface 18 and the soil layer 16 is also shown to be a sand layer 20 as located predominantly at a beach. However, the ground surface 14 and the soil layer 16 may include other ground surfaces and soil layers.

The thermally insulated container 10 comprises a bottom wall 30, a first side wall 32, a second side wall 34, a third side wall 36 and a fourth side wall 38 for defining a container 40. The container 40 defines a cavity 42 for housing the object 12 and an aperture 44 for positioning the object 12 within the cavity 42. A cover plate 46 engages the aperture 44 for covering the cavity 42.

A first anchor 50 is pivotably secured to the first side wall 32. The first anchor 50 pivots from a position where the first anchor is adjacent to the first side wall 32 to an angle wherein the first anchor 50 is least ninety degrees from the first side wall 32. The first anchor 50 may pivot below the bottom wall 30 for having the first anchor 50 engage the soil layer 16. The first anchor 50 prevents rotation of the container 40 relative to the ground surface 14. The first anchor 50 includes a first pivot arm 52 and a second pivot arm 54. A first plate 56 extends between the first pivot arm 52 and the second pivot arm 54. The first plate 56 increases the surface area of the first anchor 50 that engages either the ground surface 14 or the soil layer 16. The first plate 56 may include a first textured surface 17 for increasing the friction force between either the ground surface 14 or the soil layer 16 with the first anchor 50. A first locking arm 58 extends between the first side wall 32 and the first anchor 50 for locking the first anchor 50 relative to the first side wall 32. The first locking arm 58 secures the first anchor 50 at least ninety degrees from the first side wall 32 for preventing rotation of container 10 relative to the ground surface 14.

A second anchor 250 is pivotably secured to the second side wall 34. The second anchor 250 pivots from a position where the second anchor is adjacent to the second side wall 34 to an angle wherein the second anchor 250 is least ninety degrees from the second side wall 34. The second anchor 250 may pivot below the bottom wall 30 for having the second anchor 250 engage the soil layer 16. The second anchor 250 prevents rotation of the container 40 relative to the ground surface 14. The second anchor 250 including a first pivot arm 252 and a second pivot arm 254. A second plate 256 extends between the first pivot arm 252 and the second pivot arm 254. The second plate 256 increasing the surface area of the second anchor 250 that engages the soil layer 16. The second plate 256 may include a second textured surface 257 for increasing the friction force between either the ground surface 14 or the soil layer 16 with the second anchor 250. A second locking arm 258 extends between the second side wall 34 and the second anchor 250 for locking the second anchor 250 relative to the second side wall 34.

Figure 15:
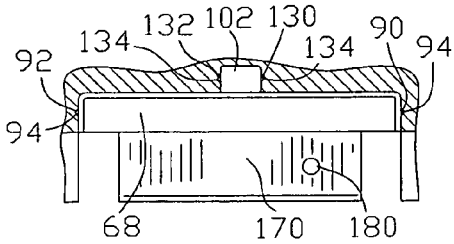
FIG. 15 is a sectional view along line 15-15 in FIG. 12.
Figure 16:
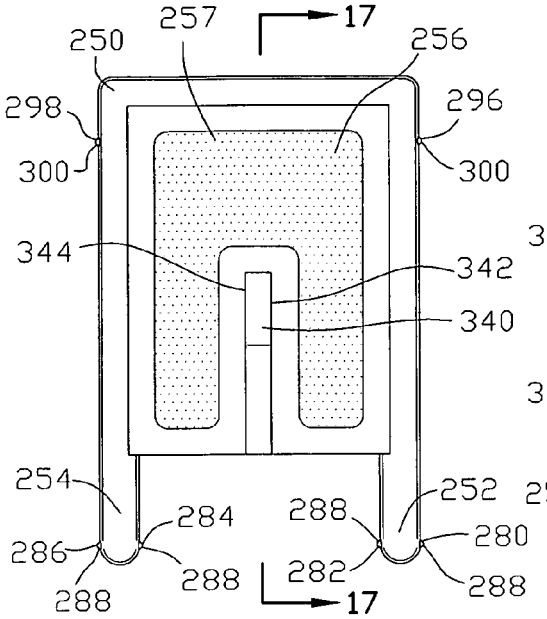
FIG. 16 is a top view of a second anchor incorporating the present invention.
Figure 17:
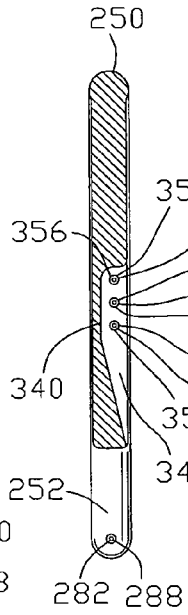
FIG. 17 is a sectional view along line 17-17 in FIG. 16.
Figure 18:
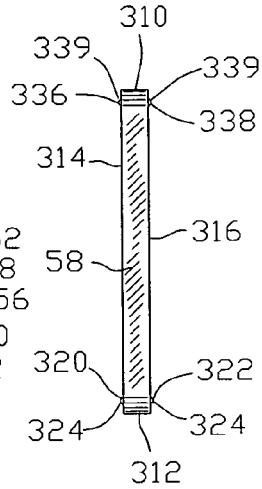
FIG. 18 is a top view of a second locking arm incorporating the present invention.
Figure 19:
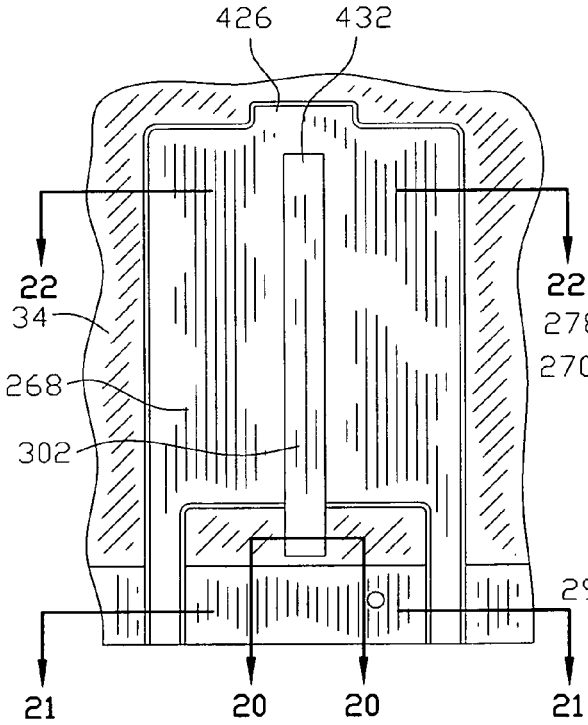
FIG. 19 is a view similar to FIG. 12 illustrating the second anchor recess and second locking arm recess.

The first anchor 50 pivots between a storage position 60 to an anchoring position 62. As best seen in FIGS. 15 and 17, the storage position 60 defines a zero degree angle 64 between the first side wall 32 and the first anchor 50. As best seen in FIGS. 1 thru 6 and 16 thru 21, the anchoring position 62 defines a greater than ninety degree angle 66 between the first side wall 32 and the first anchor 50.

The second anchor 250 pivots between a storage position 260 to an anchoring position 262. As best seen in FIGS. 15 and 17, the storage position 260 defines a zero degree angle 264 between the second side wall 34 and the second anchor 250. As best seen in FIGS. 1 thru 6 and 16 thru 21, the anchoring position 262 defines a greater than ninety degree angle 266 between the second side wall 34 and the second anchor 250.

Figure 14:
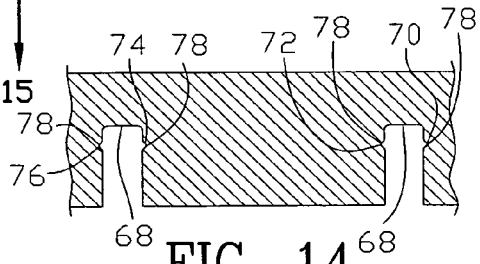
FIG. 14 is a sectional view along line 14-14 in FIG. 12.

The first side wall 32 includes a first anchor recess 68 for housing the first anchor 50 within the first side wall 32. Preferably the first anchor recess 68 has slightly larger dimensions than the first anchor 50 for allowing the first anchor recess 68 to receive the first anchor 50 and for creating a smooth outer surface as best seen in FIG. 15. As best seen in FIG. 14, the first anchor recess 68 includes a first locking pin receiver 70, a second locking pin receiver 72, a third locking pin receiver 74 and a fourth locking pin receiver 76. The first locking pin receiver 70, the second locking pin receiver 72, third locking pin receiver 74 and fourth locking pin receiver 76 include a concave bore 78. The first anchor recess 68 may include a first anchor void 424 for facilitating the removal of the first anchor 50 from the first anchor recess 68.

As best seen in FIGS. 9, 10 and 23 thru 27, the first pivot arm 52 of the first anchor 50 includes a first locking pin 80 and a second locking pin 82. The second pivot arm 54 of the first anchor 50 includes a third locking pin 84 and a fourth locking pin 86. The first locking pin 80, the second locking pin 82, the third locking pin 84 and the fourth locking pin 86 include a concave step 88 that has the identical curvature as the concave bore 78. The first locking pin 80, the second locking pin 82, the third locking pin 84 and the fourth locking pin 86 engage with the first locking pin receiver 70, the second locking pin receiver 72, third locking pin receiver 74 and fourth locking pin receiver 76 respectively, for pivoting the first anchor 50 within the first anchor recess 68 and pivoting the first anchor 50 between the zero degree angle 64 and the greater than ninety degree angle 66.

As best seen in FIGS. 2, 7 and 24 thru 27, the first anchor recess 68 further includes a first storage receiver 90 and a second storage receiver 92. The first storage receiver 90 and the second storage receiver 92 include a concave bore 94. As best seen in FIGS. 3-5, 9, 10 and 23-27, the first pivot arm 52 of the first anchor 50 includes a first storage pin 96. The second pivot arm 54 of the first anchor 50 includes a second storage pin 98. The first storage pin 96 and second storage pin 98 include a concave step 100 that has the identical curvature as the concave bore 94. The first storage pin 96 and second storage pin 98 engage with the first storage receiver 90 and the second storage receiver 92 respectively, for retaining the first anchor 50 in a storage position within the first anchor recess 68 when the first anchor 50 is not needed.

Figure 13:
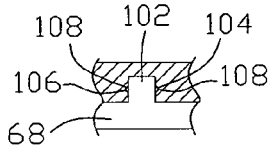
FIG. 13 is a sectional view along line 13-13 in FIG. 12.

As seen in FIGS. 1-3, 23-27, the first side wall 32 includes a first locking arm recess 102 for housing the first locking arm 58 within the first side wall 32. Preferably the first locking arm recess 102 has slightly larger dimensions than the first locking arm 58 for allowing the first locking arm recess 102 to receive the first locking arm 58 and for creating a smooth outer surface as best seen in FIG. 16. As best seen in FIG. 13, the first locking arm recess 102 includes a first locking pin receiver 104 and a second locking pin receiver 106. The first locking pin receiver 104 and the second locking pin receiver 106 of the first locking arm recess 102 include a concave bore 108. The first locking arm recess 102 may include a first arm void 430 for facilitating the removal of the first locking arm 58 from the first locking arm recess 102.

As best seen in FIGS. 11 and 23-29, the first locking arm 58 extends between an anchor end 110 and a wall end 112 and has a first side 114 and a second side 116. The wall end 112 of the first locking arm 58 engages with the first side wall 32. More specifically, the wall end 112 of the first locking arm 58 includes a first locking pin 120 positioned on the first side 114 and a second locking pin 122 positioned on the second side 116. The first locking pin 120 and second locking pin 122 of the first locking arm 58 are in an aligned orientation. Furthermore, the first locking pin 120 and the second locking pin 122 of the first locking arm 58 include a concave step 124 that has the identical curvature as the concave bore 108. The first locking pin 120 and the second locking pin 122 of the first locking arm 58 engage with the first locking pin receiver 104 and the second locking pin receiver 106 of the first locking arm recess 102 respectively, for pivoting the first locking arm 58 within the first locking arm recess 102 and pivoting the first locking arm 58 between the zero degree angle 126 and the greater than ninety degree angle 128.

As best seen in FIGS. 2, 7 and 24 thru 27, the first locking arm recess 102 further includes a first storage receiver 130 and a second storage receiver 132. The first storage receiver 130 and the second storage receiver 132 of the first locking arm recess 102 include a concave bore 134. As best seen in FIGS. 11 and 15-19, the wall end 112 of the first locking arm 58 includes a first storage pin 136 positioned on the first side 114 and a second storage pin 138 positioned on the second side 116. The first storage pin 136 and second storage pin 138 of the first locking arm 58 are in an aligned orientation. Furthermore, the first storage pin 136 and the second storage pin 138 of the first locking arm 58 include a concave step 139 that has the identical curvature as the concave bore 134. The first storage pin 136 and second storage pin 138 of the first locking arm 58 engage with the first storage receiver 130 and the second storage receiver 132 of the first locking arm recess 102 respectively, for retaining the first locking arm 58 in a storage position within the first locking arm recess 102 when the first locking arm 58 is not needed. Preferably the container 40, the first anchor recess 68, the first locking arm recess 102 constitute an integral one piece unit constructed from a polymeric material.

As seen in FIGS. 2, 3, 7, 9, 10 and 23-27, the first anchor 50 includes first channel 140 defining a first channel wall 142 and a second channel wall 144 for receiving the anchor end 110 of the first locking arm 58. A first anchor lock 146, a second anchor lock 148 and a third anchor lock 150 are positioned within the first channel 140 for locking the anchor end 110 of the first locking arm 58 to the first anchor 50 at multiple positions. More specifically, each of the first, second and third anchor locks 146, 148 and 150 includes a first arm receiver 152 and a second arm receiver 154. The first arm receiver 152 and a second arm receiver 154 include a concave bore 156. Preferably the first anchor 50 including the first pivot arm 52, second pivot arm 54, first plate 56 and first channel 140 constitute an integral one piece unit constructed from a polymeric material.

Figure 26:
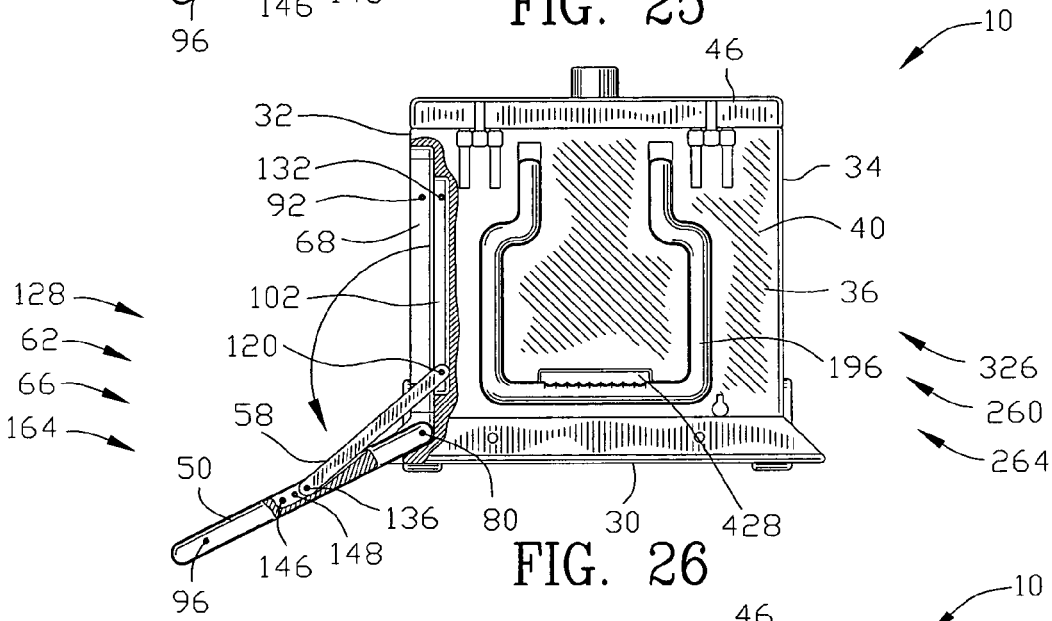
FIG. 26 is a view similar to FIG. 25 illustrating the locking arm being pivoted to engage with the anchor for positioning the anchor in a first angle.
Figure 27:
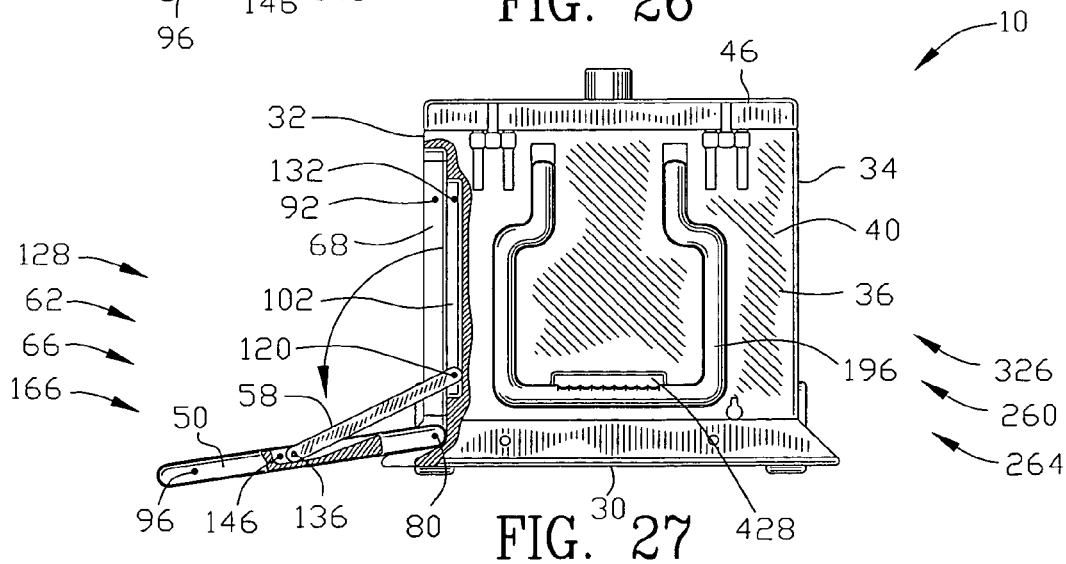
FIG. 27 is a view similar to FIG. 26 illustrating the locking arm being pivoted to engage with the anchor for positioning the anchor in a second angle.
Figure 28:
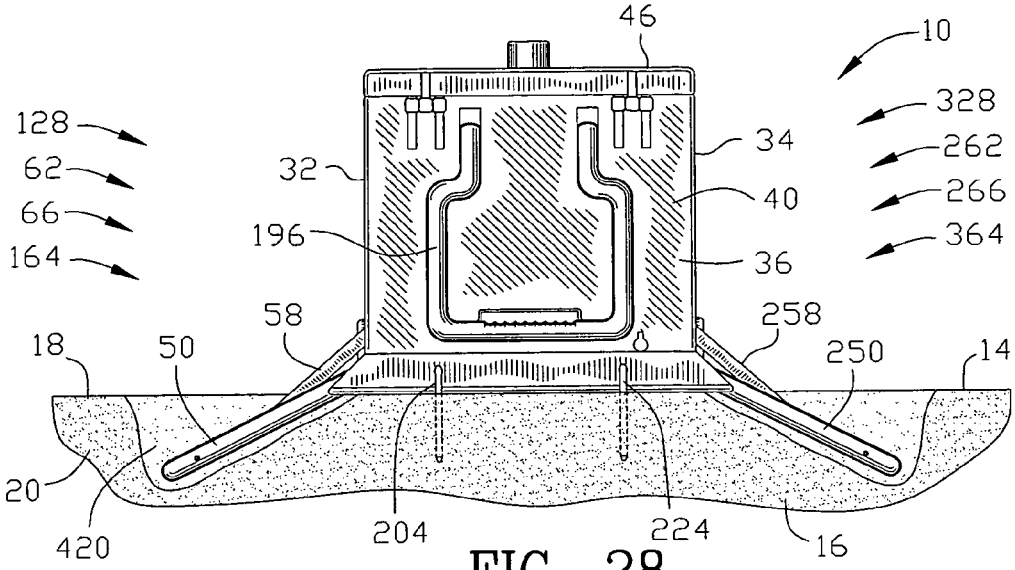
FIG. 28 is a view similar to FIG. 4 illustrating the thermally insulated container positioned above a ground surface.

As best seen in FIGS. 11 and 23-27, the anchor end 102 of the first locking arm 58 includes a first storage pin 136 positioned on the first side 114 and a second storage pin 138 positioned on the second side 116. The first storage pin 136 and the second storage pin 138 of the first locking arm 58 are in an aligned orientation. Furthermore, the first storage pin 136 and the second storage pin 138 of the first locking arm 58 include a concave step 139 that has the identical curvature as the concave bore 156. The first storage pin 136 and second storage pin 138 of the first locking arm 58 engage with the first, second or third anchor locks 146, 148 and 150 for retaining the first locking arm 58 relative to the first anchor 50. By altering the position of the first storage pin 136 and second storage pin 138 between the first, second or third anchor locks 146, 148 and 150 the angle between the first side wall 32 and the first anchor 50 may be changed. By changing the angle between the first side wall 32 and the first anchor 50, the depth that the first anchor 50 travels below the ground surface 14 may be adjusted. As seen in FIG. 26, positioning the first storage pin 136 and second storage pin 138 in the first anchor lock 146 will position the first anchor 50 at a first angle 164 relative to the container 40 and will increase the depth of the first anchor 50 relative to the ground surface 14. As seen in FIG. 27, positioning the first storage pin 136 and second storage pin 138 in the second anchor lock 148 will position the first anchor 50 at a second angle 166 relative to the container 40 and will decrease the depth of the first anchor 50 relative to the ground surface 14. By positioning the first storage pin 136 and second storage pin 138 in the third anchor lock 150 will position the first anchor 50 at a third angle 168 relative to the container 40 and secure the first anchor 50 perpendicular to the first side wall 32. With the first anchor 50 perpendicular to the first side wall 32 the first anchor 50 is positioned adjacent to the ground surface 14 and is not positioned within the soil layer 16. Preferably the first locking arm 58 constitutes an integral one piece unit constructed from a polymeric material.

Similarly to the first anchor 50 and best seen in FIGS. 4-7, the second anchor 250 pivots between a storage position 260 to an anchoring position 262. Similar to the first anchor 50 as best seen in FIGS. 15 and 17, the storage position 260 of the second anchor 250 defines a zero degree angle 264 between the second side wall 34 and the second anchor 250. Similar to the first anchor 50 as best seen in FIGS. 1 thru 6 and 16 thru 21, the anchoring position 262 of the second anchor 250 defines a greater than ninety degree angle 266 between the second side wall 34 and the second anchor 250.

The second anchor 250 pivots between a storage position 260 to an anchoring position 262. The storage position 260 defines a zero degree angle 264 between the second side wall 34 and the second anchor 250. As best seen in FIGS. 1 thru 6 and 16 thru 21, the anchoring position 262 defines a greater than ninety degree angle 266 between the second side wall 34 and the second anchor 250.

As best seen in FIGS. 16-22, the second side wall 34 includes a second anchor recess 268 for housing the second anchor 250 within the second side wall 34. Preferably the second anchor recess 268 has slightly larger dimensions than the second anchor 250 for allowing the second anchor recess 268 to receive the second anchor 250 and for creating a smooth outer surface. The second anchor recess 268 includes a first locking pin receiver 270, a second locking pin receiver 272, a third locking pin receiver 274 and a fourth locking pin receiver 276. The second locking pin receiver 270, the second locking pin receiver 272, third locking pin receiver 274 and fourth locking pin receiver 276 include a concave bore 278. The second anchor recess 268 may include a second anchor void 426 for facilitating the removal of the second anchor 250 from the second anchor recess 268.

The first pivot arm 252 of the second anchor 250 includes a first locking pin 280 and a second locking pin 282. The second pivot arm 254 of the second anchor 250 includes a third locking pin 284 and a fourth locking pin 286. The first locking pin 280, the second locking pin 282, the third locking pin 284 and the fourth locking pin 286 include a concave step 288 that has the identical curvature as the concave bore 278. The first locking pin 280, the second locking pin 282, the third locking pin 284 and the fourth locking pin 286 engage with the first locking pin receiver 270, the second locking pin receiver 272, third locking pin receiver 274 and fourth locking pin receiver 276 respectively, for pivoting the second anchor 250 within the second anchor recess 268 and pivoting the second anchor 250 between the zero degree angle 264 and the greater than ninety degree angle 266.

As best seen in FIGS. 16-22, the second anchor recess 268 further includes a first storage receiver 290 and a second storage receiver 292. The first storage receiver 290 and the second storage receiver 292 include a concave bore 294. The second pivot arm 252 of the second anchor 250 includes a first storage pin 296. The second pivot arm 254 of the second anchor 250 includes a second storage pin 298. The first storage pin 296 and second storage pin 298 of the second anchor 250 include a concave step 300 that has the identical curvature as the concave bore 294. The first storage pin 296 and second storage pin 298 of the second anchor 250 engage with the first storage receiver 290 and the second storage receiver 292 of the second anchor recess respectively, for retaining the second anchor 250 in a storage position within the second anchor recess 268 when the second anchor 250 is not needed.

The second side wall 34 includes a second locking arm recess 302 for housing the second locking arm 258 within the second side wall 34. Preferably the second locking arm recess 302 has slightly larger dimensions than the second locking arm 258 for allowing the second locking arm recess 302 to receive the second locking arm 258 and for creating a smooth outer surface. The second locking arm recess 302 includes a first locking pin receiver 304 and a second locking pin receiver 306. The first locking pin receiver 304 and the second locking pin receiver 306 of the second locking arm recess 302 include a concave bore 308. The second locking arm recess 302 may include a second arm void 432 for facilitating the removal of the second locking arm 258 from the second locking arm recess 302.

The second locking arm 258 extends between an anchor end 310 and a wall end 312 and has a first side 314 and a second side 316. The wall end 312 of the second locking arm 258 engages with the second side wall 34. More specifically, the wall end 312 of the second locking arm 258 includes a first locking pin 320 positioned on the first side 314 and a second locking pin 322 positioned on the second side 316. The first locking pin 320 and second locking pin 322 of the second locking arm 258 are in an aligned orientation. Furthermore, the first locking pin 320 and the second locking pin 322 of the second locking arm 258 include a concave step 324 that has the identical curvature as the concave bore 308. The first locking pin 320 and the second locking pin 322 of the second locking arm 258 engage with the first locking pin receiver 304 and the second locking pin receiver 306 of the second locking arm recess 302 respectively, for pivoting the second locking arm 258 within the second locking arm recess 302 and pivoting the second locking arm 258 between the zero degree angle 326 and the greater than ninety degree angle 328.

The second locking arm recess 302 further includes a first storage receiver 330 and a second storage receiver 332. The first storage receiver 330 and the second storage receiver 332 of the second locking arm recess 302 include a concave bore 334. The wall end 312 of the second locking arm 258 includes a first storage pin 336 positioned on the first side 314 and a second storage pin 338 positioned on the second side 316. The first storage pin 336 and second storage pin 338 of the second locking arm 258 are in an aligned orientation. Furthermore, the first storage pin 336 and the second storage pin 338 of the second locking arm 258 include a concave step 338 that has the identical curvature as the concave bore 334. The first storage pin 336 and second storage pin 338 of the second locking arm 258 engage with the first storage receiver 330 and the second storage receiver 332 of the second locking arm recess 302 respectively, for retaining the second locking arm 258 in a storage position within the second locking arm recess 302 when the second locking arm 258 is not needed. Preferably the container 40, the second anchor recess 268, the second locking arm recess 302 constitute an integral one piece unit constructed from a polymeric material.

Similar to the first anchor 50 as seen in FIGS. 16-22 and 23-27, the second anchor 250 includes second channel 340 defining a first channel wall 342 and a second channel wall 344 for receiving the anchor end 310 of the second locking arm 258. A first anchor lock 346, a second anchor lock 348 and a third anchor lock 350 are positioned within the second channel 340 for locking the anchor end 310 of the second locking arm 258 to the second anchor 250 at multiple positions. More specifically, each of the first, second and third anchor locks 346, 348 and 350 of the second anchor 250 includes a first arm receiver 352 and a second arm receiver 354. The first arm receiver 352 and a second arm receiver 354 include a concave bore 356. Preferably the second anchor 250 including the first pivot arm 252, second pivot arm 254, second plate 256 and second channel 340 constitute an integral one piece unit constructed from a polymeric material.

The anchor end 302 of the second locking arm 258 includes a first anchor pin 358 positioned on the first side 314 and a second anchor pin 360 positioned on the second side 316. The first anchor pin 358 and the second anchor pin 360 of the second locking arm 258 are in an aligned orientation. Furthermore, the first anchor pin 358 and the second anchor pin 360 of the second locking arm 258 include a concave step 362 that has the identical curvature as the concave bore 356. The first anchor pin 358 and second anchor pin 360 of the second locking arm 258 engage with the first, second or third anchor locks 346, 348 and 350 for retaining the second locking arm 258 relative to the second anchor 250. By altering the position of the second anchor pin 358 and the second anchor pin 360 between the first, second or third anchor locks 346, 348 and 350 the angle between the second side wall 34 and the second anchor 250 may be changed. By changing the angle between the second side wall 34 and the second anchor 250, the depth that the second anchor 250 travels below the ground surface 14 may be adjusted. Positioning the first anchor pin 358 and second anchor pin 360 of the second locking arm 258 in the first anchor lock 346 will position the second anchor 250 at a first angle 364 relative to the container 40 and will increase the depth of the second anchor 250 relative to the ground surface 14. Positioning the first anchor pin 358 and second anchor pin 360 of the second locking arm 258 in the second anchor lock 348 will position the second anchor 250 at a second angle 366 relative to the container 40 and will decrease the depth of the second anchor 250 relative to the ground surface 14. By positioning the first anchor pin 358 and second anchor pin 360 of the second locking arm 258 in the third anchor lock 350 will position the second anchor 250 at a third angle 368 relative to the container 40 and secure the second anchor 250 perpendicular to the second side wall 34. With the second anchor 250 perpendicular to the second side wall 34 the second anchor 250 is positioned adjacent to the ground surface 14 and is not positioned within the soil layer 16. Preferably the second locking arm 258 constitutes an integral one piece unit constructed from a polymeric material.

As best seen in FIGS. 1-7 and FIGS. 23-29, the first side wall 32 may include a first taper 170 positioned adjacent to the bottom wall 30 for increasing contact between the first side wall 32 and the ground surface 18. The second side wall 34 may include a second taper 172 positioned adjacent to the bottom wall 30 for increasing contact between the second side wall 34 and the ground surface 18. The third side wall 36 may include a third taper 174 positioned adjacent to the bottom wall 30 for increasing contact between the third side wall 36 and the ground surface 18. The fourth side wall 38 may including a fourth taper 176 positioned adjacent to the bottom wall 30 for increasing contact between the fourth side wall 38 and the ground surface 18. The first taper 170, second taper 172, third taper 174, and fourth taper 176 also increase the contact area between the bottom wall 30 and the ground surface 18 for preventing rotation of the container 10 relative to the ground surface 14. Preferably, the first taper 170, second taper 172, third taper 174, fourth taper 176 and the container 10 constitutes an integral one piece unit constructed from a polymeric material.

The first taper 170 may include a first bore 180 that traverses through the first taper 170. The first bore 180 receives a first stake 182 that traverses through the first bore 180 and burrows into the soil layer 16 for preventing rotation of the container 10 relative to the ground surface 14. The first stake 182 may include a first U-shaped stake 184 that engages through the first bore 180 and around the first taper 170 to burrow into the soil layer 16. The second taper 172 may include a second bore 190 that traverses through the second taper 172. The second bore 190 receives a second stake 192 that traverses through the second bore 190 and burrows into the soil layer 16 for preventing rotation of the container 10 relative to the ground surface 14. The second stake 192 may include a second U-shaped stake 194 that engages through the second bore 190 and around the second taper 172 to burrow into the soil layer 16. The third taper 174 may include a third bore 200 that traverses through the third taper 174. The third bore 200 receives a third stake 202 that traverses through the third bore 200 and burrows into the soil layer 16 for preventing rotation of the container 10 relative to the ground surface 14. The third stake 202 may include a first U-shaped stake 204 that engages through the third bore 200 and around the third taper 174 to burrow into the soil layer 16. The fourth taper 176 may include a fourth bore 210 that traverses through the fourth taper 176. The fourth bore 210 receives a fourth stake 212 that traverses through the fourth bore 210 and burrows into the soil layer 16 for preventing rotation of the container 10 relative to the ground surface 14. The fourth stake 212 may include a fourth U-shaped stake 214 that engages through the fourth bore 210 and around the fourth taper 176 to burrow into the soil layer 16.

The third taper 174 may further include a fifth bore 220 that traverses through the third taper 174. The fifth bore 220 receives a fifth stake 222 that traverses through the fifth bore 220 and burrows into the soil layer 16 for preventing rotation of the container 10 relative to the ground surface 14. The fifth stake 222 may include a first U-shaped stake 224 that engages through the fifth bore 220 and around the third taper 174 to burrow into the soil layer 16. The fourth taper 176 may further include a sixth bore 230 that traverses through the fourth taper 176. The second sixth bore 230 receives a sixth stake 232 that traverses through the sixth bore 230 and burrows into the soil layer 16 for preventing rotation of the container 10 relative to the ground surface 14. The sixth stake 232 may include a sixth U-shaped stake 234 that engages through the sixth bore 230 and around the fourth taper 176 to burrow into the soil layer 16.

As best seen in FIGS. 1-29, the first side wall 32 includes a first wheel 178 for elevating the container 40 over the ground surface 14. Similarly, the second side wall 34 includes a second wheel 179 for elevating the container 40 over the ground surface 14. The first wheel 178 and second wheel 179 are secured to the container 40 by an axle 186. The bottom wall 30 includes an axle bore 188 traversing from the first side wall 32 to the second side wall 34 in order to receive the axle 186. The axle 186 may further include a first axle lug 187 and a second axle lug 189 for retaining the first wheel 178 and the second wheel 179 to the axle 186 respectively.

Figure 7:
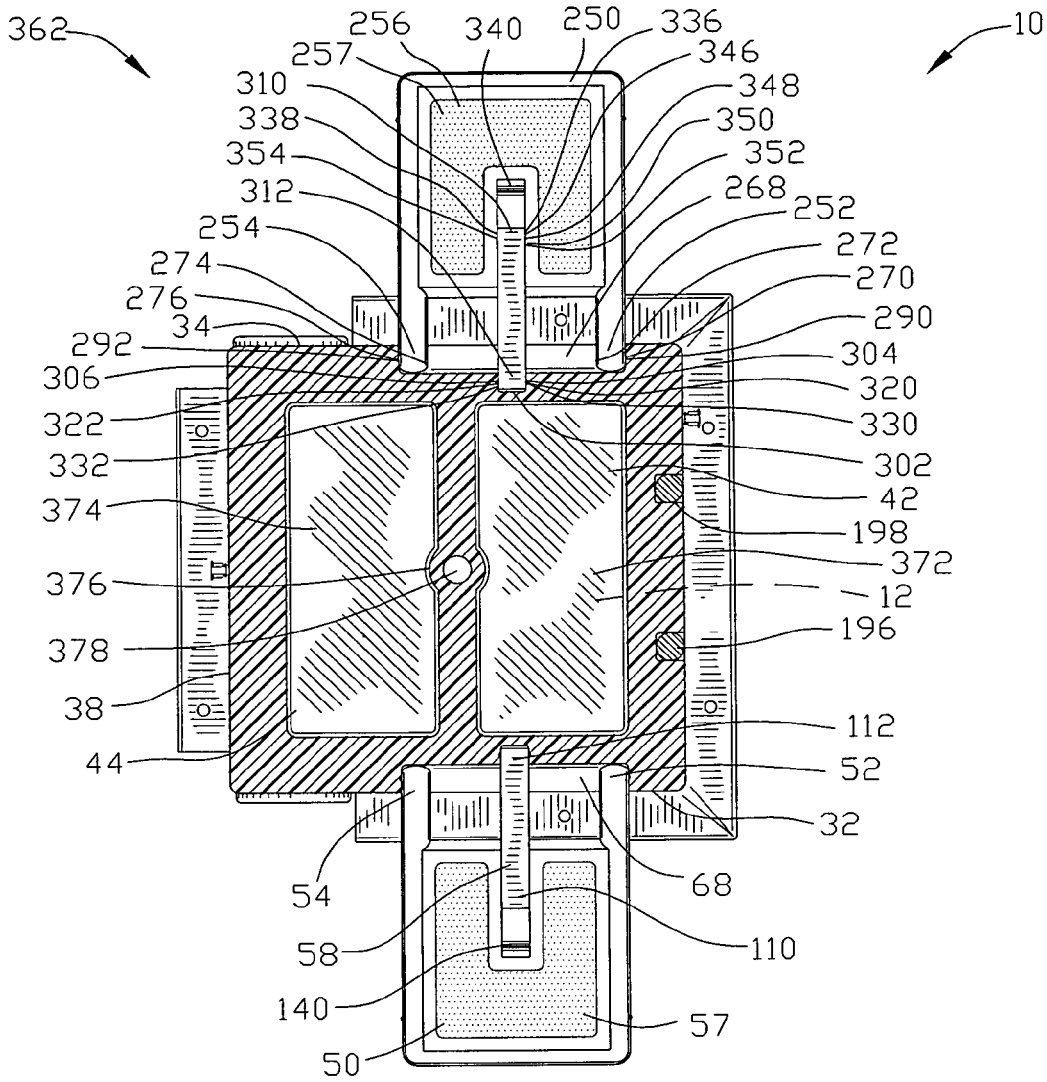
FIG. 7 is a sectional view along line 7-7 in FIG. 3.
Figure 8:
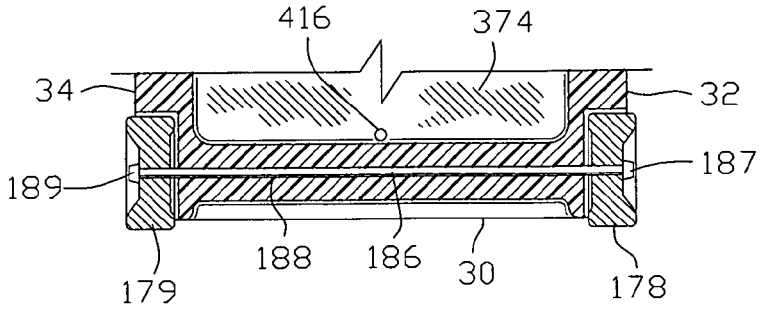
FIG. 8 is a sectional view along line 8-8 in FIG. 3.

The third side wall 36 may include a handle 196 to pivot the container 40 upon the first wheel 178 and the second wheel 179 for rolling the container 40 over the ground surface 14. The handle 196 includes a first pivot end 197 and a second pivot end 199. The third side wall 36 may further include a handle recess 198 for housing the handle 196 within the third side 36. Preferably the handle recess 198 has slightly larger dimensions than the handle 196 for allowing the handle recess 198 to receive the handle 196 and for creating a smooth outer surface as best seen in FIGS. 13 and 7. The handle recess 198 may include a handle void 388 for facilitating the removal of the handle 196 from the handle recess 198.

Figure 9:
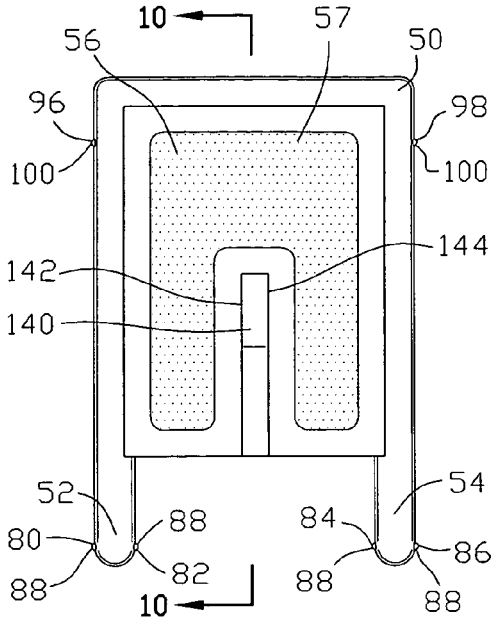
FIG. 9 is a top view of a first anchor incorporating the present invention.
Figure 10:
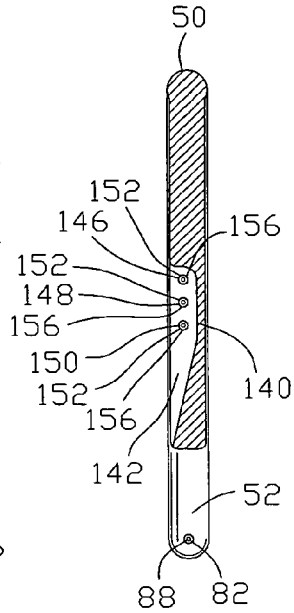
FIG. 10 is a sectional view along line 10-10 in FIG. 9.
Figure 11:
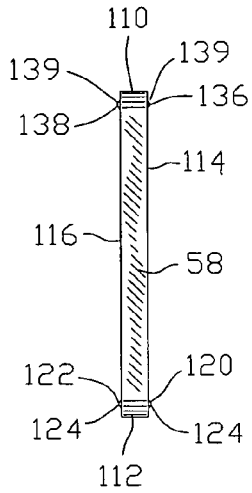
FIG. 11 is a top view of a first locking arm incorporating the present invention.
Figure 12:
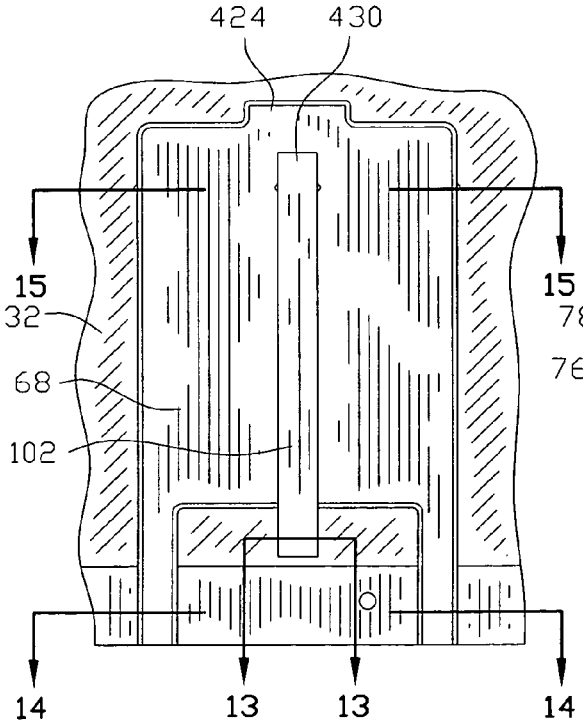
FIG. 12 is a magnified view of a portion of FIG. 3 illustrating the first anchor recess and first locking arm recess.

The securing and pivoting between the handle 196 and the container 40 is similar to the configuration between the first anchor 50 and the first anchor recess 68 as best seen in FIGS. 9 and 14. The handle recess 198 includes a first handle receiver 206, a second handle receiver 207, a third handle receiver 208 and a fourth handle receiver 209. The first handle receiver 206, the second handle receiver 207, third handle receiver 208 and fourth handle receiver 209 include a concave bore 228.

The first pivot end 197 of the handle 196 includes a first handle pin 216 and a second handle pin 217. The second pivot end 199 of the handle 196 includes a third handle pin 218 and a fourth handle pin 219. The first handle pin 216, the second handle pin 217, the third handle pin 218 and the fourth handle pin 219 include a concave step 226 that has the identical curvature as the concave bore 228. The first handle pin 216, the second handle pin 217, the third handle pin 218 and the fourth handle pin 219 engage with the first handle receiver 206, the second handle receiver 207, third handle receiver 208 and fourth handle receiver 209 respectively, for pivoting the handle 196 from the handle recess 198 to an approximate vertical position.

The cavity 42 of the container 40 may include an interior wall 370 that extends from the bottom wall 30 to within the cavity 42. Preferably, the interior wall 370 extends to the equivalent level as the aperture 44. The interior wall 370 divides the cavity 42 into a first cavity 372 and a second cavity 374. The interior wall 370 and the container 40 may constitute an integral one piece unit constructed from a polymeric material.

The interior wall 370 includes a cylinder 376. The cylinder 376 has a bore 378 for receiving a shaft 379. The shaft 379 includes a base end 380 and a terminal end 382. The base end 380 of the shaft 379 is inserted into the bore 378 for supporting and extending the shaft 379 above the container 40. The terminal end 382 of the shaft 379 supports an umbrella 384. The umbrella 384 includes a receiver 386 and a canopy 388. The receiver 386 slidably engages the terminal end 382 of the shaft 379 for positioning the canopy 388 above the container 40. The canopy 388 provides a sheltered area 390 on the ground surface 14 that is positioned below the canopy 388. The canopy 388 may shield the sheltered area 390 from rain, sun light or other objects from striking the sheltered area 390. The umbrella 384 may include a collapsible umbrella 392. The cylinder 376 of the internal wall 370 may further include a wing bolt 394 that threadably engages through the cylinder 376 to press against the shaft 379 for locking the shaft 379 relative to the cylinder 376. With the umbrella 384 deployed above the container 40, the weight of the container 40 and the area of the bottom wall 30 alone may not be sufficient to resist a moment force applied to the umbrella 384. As such the engaging of the first anchor 50 and the second anchor 250 with either the ground surface 14 or the soil layer 16 may become crucial in order to apply an opposing moment force to the container 40 to counter the moment force applied to the umbrella 384. If the first anchor 50 and the second anchor 250 are able to counter in the moment force applied to the umbrella 384, the first anchor 50 and the second anchor 250 would prevent rotation of the container 40 relative to the ground surface 14.

The cover 46 including a first cover 400 and a second cover 402. The first cover 400 may be pivotably hinged to the first side wall 32 by a first hinge 404. The second cover 402 may similarly be pivotably hinged to the second side wall 34 by a second hinge 406. The first side wall 32 may further include a third hinge 408 for also pivotably hinging the first cover 400 to the first side wall 32. Furthermore, the second side wall 34 may further include a fourth hinge 410 for also pivotably hinging the second cover 402 to the second side wall 34.

The first cavity 372 of the container 40 may include a first drain port 412 for draining the first cavity 372 of any fluid. A first plug 414 may be positioned within the first drain port 412 for plugging the first drain port 412. Furthermore, the second cavity 374 of the container 40 may include a second drain port 416 for draining the second cavity 374 of any fluid. A second plug 418 may be positioned within the second drain port 416 for plugging the second drain port 416.

Figure 20:
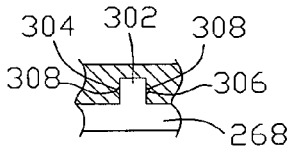
FIG. 20 is a sectional view along line 20-20 in FIG. 19.
Figure 21:
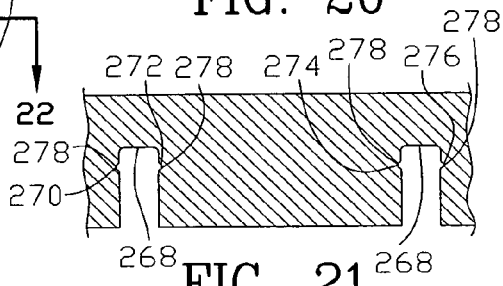
FIG. 21 is a sectional view along line 21-21 in FIG. 19.
Figure 22:
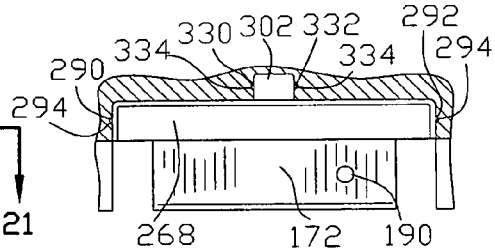
FIG. 22 is a sectional view along line 22-22 in FIG. 19.
Figure 23:
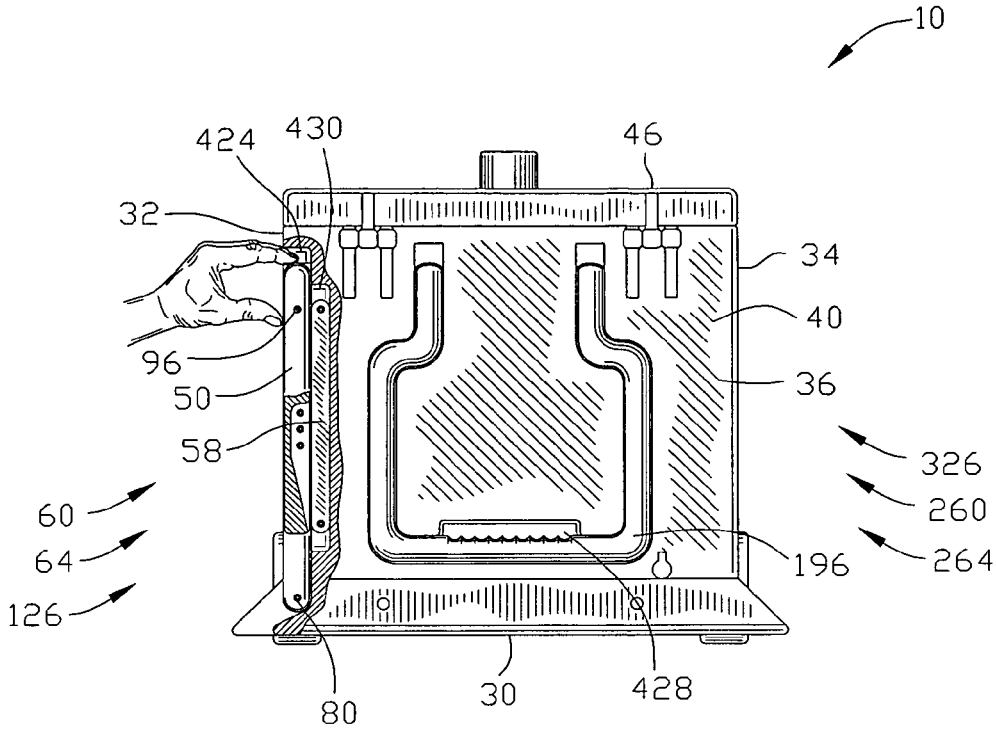
FIG. 23 is a view similar to FIG. 4 illustrating the anchor being disengaged with the thermally insulated container.
Figure 24:
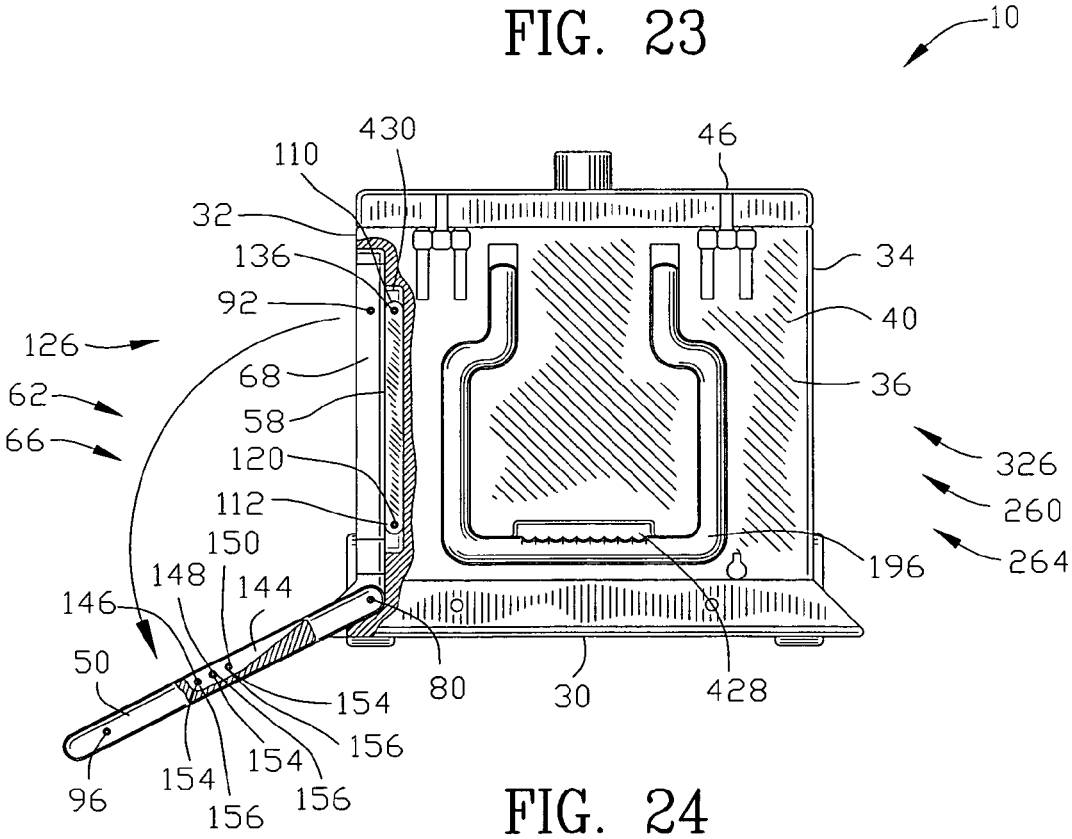
FIG. 24 is a view similar to FIG. 23 illustrating the anchor being pivoted to a position below the thermally insulated container.
Figure 25:
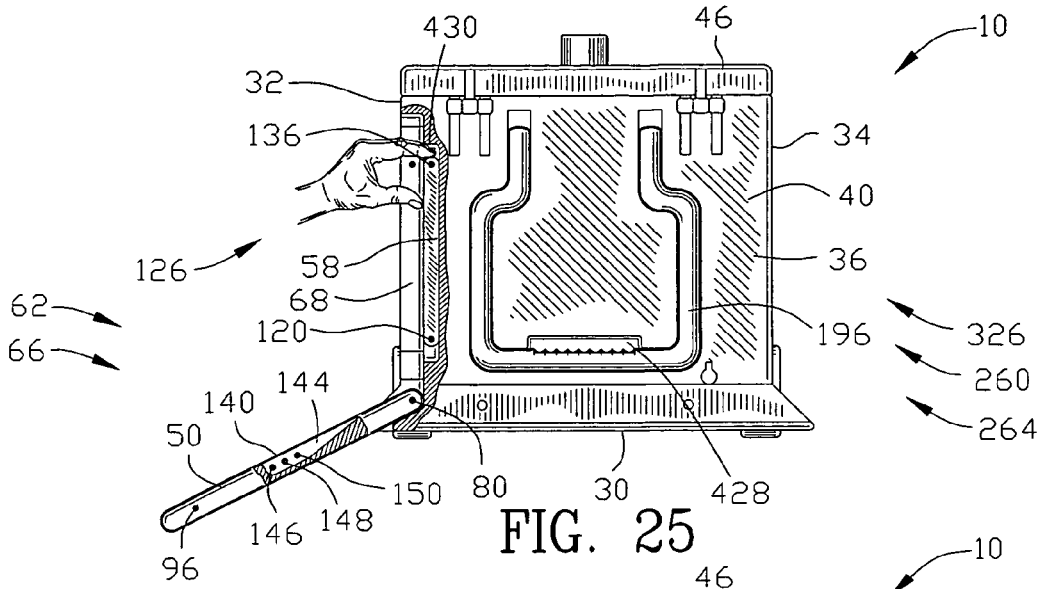
FIG. 25 is a view similar to FIG. 24 illustrating the locking arm being disengaged with the thermally insulated container.
Figure 29:
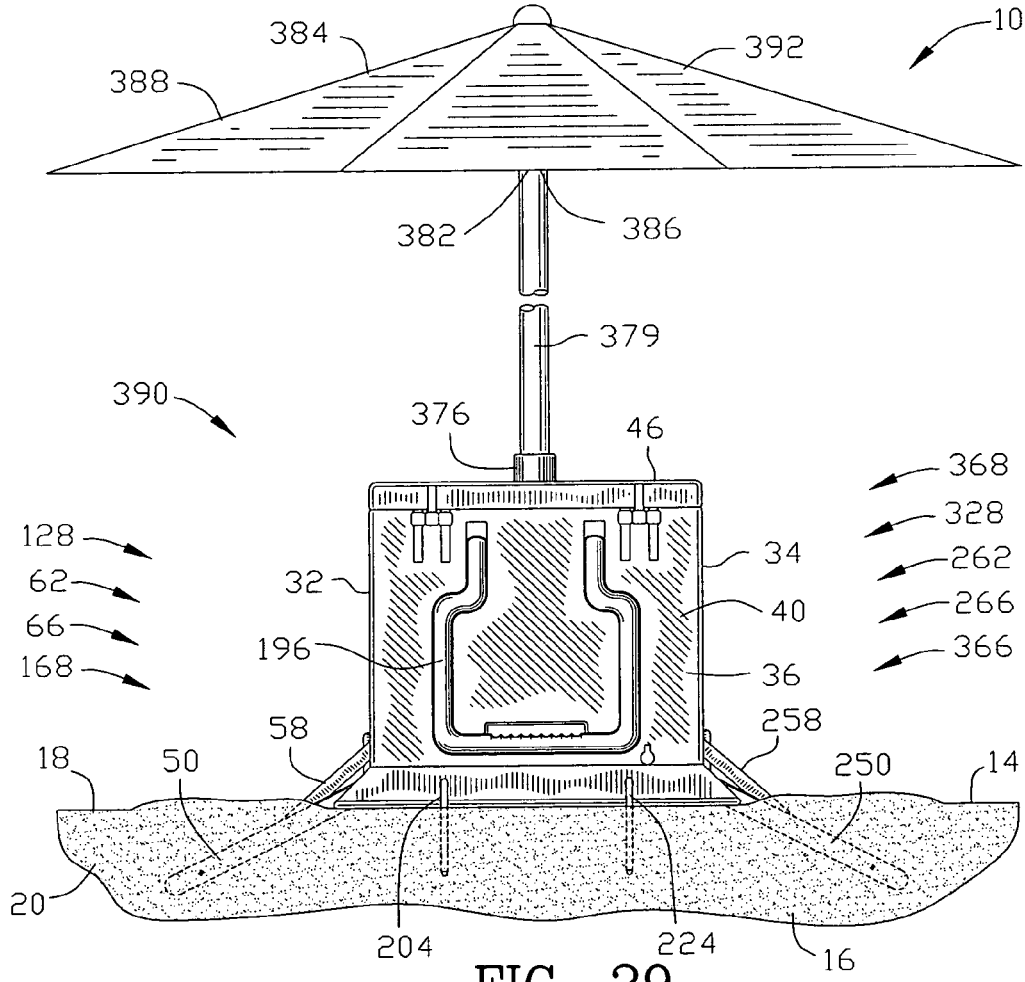
FIG. 29 is a view similar to FIG. 28 illustrating a soil layer securing the thermally insulated container and an umbrella engaging the thermally insulated container.

FIGS. 23-29 illustrate the steps taken in order to utilize the container 40. The container 40 is first positioned upon the ground surface 14. A first hole 420 is excavated adjacent to the first side wall 32 and a second hole 422 is excavated adjacent to the second side wall 34. As best seen in FIGS. 15, 16 and 20, the first and second anchors 50 and 250 are removed from the first and second anchor recesses 68 and 268, respectively. The first and second anchors 50 and 250 are positioned within the first hole 420 and the second hole 422, respectively. As seen in FIGS. 23-27, the first and second locking arm 58 and 258 are then disengaged from the first and second locking arm recess 102 and 302, respectively to engage with the first and second anchors 50 and 250 respectively. Upon the first and second locking arm 58 and 258 engaging with the first and second anchors 50 and 250, the first and second locking arm 58 and 258 prevent further pivoting of the first and second anchors 50 and 250 relative to the first and second side wall 32 and 34, respectively. As best seen in FIG. 29, the soil layer 16 is then positioned over the first and second anchors 50 and 250 in order to fill the first and second holes 420 and 422 respectively. Once the first and second anchor 50 and 250 are burrowed within the first and second holes 420 and 422, the first and second anchors 50 and 250 further restrict the container 40 along with the umbrella 344 from rotation relative to the ground surface 14. Alternatively or in conjunction with, the first, second, third, fourth, fifth, and sixth stake 182, 192, 202, 212, 222 and 232 may be utilized to further prevent rotation of the container 40 relative to the ground surface 14.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A thermally insulated container for maintaining thermo energy of an object, the thermally insulated container positioned over a ground surface, the ground surface covering a soil layer, the thermally insulated container, comprising:

a bottom wall, a first side wall, a second side wall, a third side wall and a fourth side wall for defining a container;

said container defining a cavity for housing the object and an aperture for positioning the object within said cavity;

a cover plate engaging said aperture for covering said cavity;

a first anchor pivotably secured to said first side wall and pivoting from said first side wall to a position below said bottom wall for preventing rotation of said container relative to the ground surface;

said first anchor including a first pivot arm and a second pivot arm;

a first plate extending between said first pivot arm and said second pivot arm for engaging the soil layer;

a first locking arm extending between said first side wall and said first anchor for locking said first anchor relative to said first side wall;

a second anchor pivotably secured to said second side wall and pivoting from said second side wall to a position below said bottom wall for preventing rotation of said container relative to the ground surface;

said second anchor including a first pivot arm and a second pivot arm;

a second plate extending between said first pivot arm and said second pivot arm of said second anchor for engaging the soil layer; and a second locking arm extending between said second side wall and said second anchor for locking said second anchor relative to said second side wall.

2. A thermally insulated container for maintaining the thermo energy of an object as set forth in claim 1, wherein said first anchor pivots between a storage position and an anchoring position;

said storage position defining a zero degree angle between said first side wall and said first anchor;

said anchoring position defining a greater than ninety degree angle between said first side wall and said first anchor;

said second anchor pivots between a storage position to an anchoring position;

said storage position defining a zero degree angle between said second side wall and said second anchor; and said anchoring position defining a greater than ninety degree angle between said second side wall and said second anchor.

3. A thermally insulated container for maintaining the thermo energy of an object as set forth in claim 1, wherein a cylinder having a bore extends from said bottom wall and into said cavity;

a shaft having a base end and a terminal end;

said base end of said shaft engaging said bore of said cylinder for securing said shaft to said container;

an umbrella having a receiver and a canopy;

said receiver of said umbrella engaging said terminal end of said shaft; and said first anchor and said second anchor preventing rotation of umbrella relative to the ground surface.

4. A thermally insulated container for maintaining the thermo energy of an object as set forth in claim 1, wherein an interior wall extends from said bottom wall and within said cavity for dividing said cavity into a first cavity and a second cavity;

said interior wall including a cylinder having a bore;

a shaft having a base end and a terminal end;

said cover including a first cover and a second cover;

said first side wall including a first hinge pivoting said first cover to said container;

said second side wall including a second hinge for pivoting said second cover to said container;

said base end of said shaft engaging said bore of said cylinder for securing said shaft to said container;

an umbrella having a receiver and a canopy;

said receiver of said umbrella engaging said terminal end of said shaft; and said first anchor and said second anchor preventing rotation of umbrella relative to the ground surface.

5. A thermally insulated container for maintaining the thermo energy of an object as set forth in claim 1, wherein said first anchor including a first lock receiver and a second lock receiver;

said first lock receiver of said first anchor engaging said first locking arm for positioning said first anchor at a first angle relative to said container;

said second lock receiver of said first anchor engaging said first locking arm for positioning said first anchor at a second angle relative to said container;

said second anchor including a first lock receiver and a second lock receiver;

said first lock receiver of said second anchor engaging said second locking arm for positioning said second anchor at a first angle relative to said container; and said second lock receiver of said second anchor engaging said second locking arm for positioning said second anchor at a second angle relative to said container.

6. A thermally insulated container, for maintaining the thermo energy of an object as set forth in claim 1, wherein said first side wall including a first taper positioned adjacent to said bottom wall for increasing contact between said first side wall and the ground surface;

said second side wall including a second taper positioned adjacent to said bottom wall for increasing contact between said second side wall and the ground surface;

said third side wall including a third taper positioned adjacent to said bottom wall for increasing contact between said third side wall and the ground surface;

said fourth side wall including a fourth taper positioned adjacent to said bottom wall for increasing contact between said fourth side wall and the ground surface; and said first taper, said second taper, said third taper and said fourth taper preventing rotation of container relative to the ground surface.

7. A thermally insulated container for maintaining the thermo energy of an object as set forth in claim 1, wherein said first side wall including a first taper positioned adjacent to said bottom wall for increasing contact between said first side wall and the ground surface;

said first taper including a first bore for receiving a first stake;

said second side wall including a second taper positioned adjacent to said bottom wall for increasing contact between said second side wall and the ground surface;

said second taper including a second bore for receiving a second stake;

said third side wall including a third taper positioned adjacent to said bottom wall for increasing contact between said third side wall and the ground surface;

said third taper including a third bore for receiving a third stake;

said fourth side wall including a fourth taper positioned adjacent to said bottom wall for increasing contact between said fourth side wall and the ground surface;

said fourth taper including a fourth bore for receiving a fourth stake;

said first taper, said second taper, said third taper and said fourth taper preventing rotation of container relative to the ground surface; and said first stake, said second stake, said third stake and said fourth stake engaging the soil layer for preventing rotation of container relative to the ground surface.

8. A thermally insulated container for maintaining the thermo energy of an object as set forth in claim 1, wherein said first side wall including a first wheel for elevating said container over the ground surface;

said second side wall including a second wheel for elevating said container over the ground surface; and said third side wall including a handle to pivot said container upon said first wheel and said second wheel for rolling said container over the ground surface.

9. A thermally insulated container for maintaining the thermo energy of an object as set forth in claim 1, wherein said first side wall including a first anchor recess for housing said first anchor within said first side wall; and said second side wall including a second anchor recess for housing said second anchor within said second side wall.

10. A thermally insulated container for maintaining the thermo energy of an object as set forth in claim 1, wherein said first side wall including a first locking arm recess for housing said first locking arm within said first side wall; and said second side wall including a second locking arm recess for housing said second locking arm within said second side wall.

11. A thermally insulated container for maintaining the thermo energy of an object as set forth in claim 1, wherein said first anchor including a first locking pin and a second locking pin;

said first side wall including a first anchor recess for housing said first anchor within said first side wall;

said first anchor recess including a first locking pin receiver and a second locking pin receiver;

said first locking pin receiver and said second locking pin receiver of said first anchor recess engaging said first locking pin and said second locking pin of said first anchor respectively for pivoting said first anchor within said first anchor recess;

said second anchor including a first locking pin and a second locking pin;

said second side wall including a second anchor recess for housing said second anchor within said second side wall;

said second anchor recess including a first locking pin receiver and a second locking pin receiver; and said first locking pin receiver and said second locking pin receiver of said second anchor recess engaging said first locking pin and said second locking pin of said second anchor respectively for pivoting said second anchor within said second anchor recess.

12. A thermally insulated container for maintaining the thermo energy of an object as set forth in claim 1, wherein said first locking arm including a first locking pin and a second locking pin;

said first side wall including a first locking arm recess for housing said first locking arm within said first side wall;

said first locking arm recess including a first locking pin receiver and a second locking pin receiver;

said first locking pin receiver and said second locking pin receiver of said first locking arm recess engaging said first locking pin and said second locking pin of said first locking arm respectively for pivoting said first locking arm within said first locking arm recess;

said second locking arm including a first locking pin and a second locking pin;

said second side wall including a second locking arm recess for housing said second locking arm within said second side wall;

said second locking arm recess including a first locking pin receiver and a second locking pin receiver; and said first locking pin receiver and said second locking pin receiver of said second locking arm recess engaging said first locking pin and said second locking pin of said second locking arm respectively for pivoting said second locking arm within said second locking arm recess.

13. A thermally insulated container for maintaining thermo energy of an object, the thermally insulated container positioned over a ground surface, the ground surface covering a soil layer, the thermally insulated container, comprising:

a bottom wall, a first side wall, a second side wall, a third side wall and a fourth side wall for defining a container;

said container defining a cavity for housing the object and an aperture for positioning the object within said cavity;

a cover plate engaging said aperture for covering said cavity;

a first anchor pivotably secured to said first side wall and pivoting from said first side wall to a position below said bottom wall for preventing rotation of said container relative to the ground surface;

said first anchor including a first pivot arm and a second pivot arm;

a first plate extending between said first pivot arm and said second pivot arm for engaging the soil layer;

a first locking arm extending between said first side wall and said first anchor for locking said first anchor relative to said first side wall;

said first anchor pivots between a storage position to an anchoring position;

said storage position defining a zero degree angle between said first side and said first anchor;

said anchoring position defining a greater than ninety degree angle between said first side and said first anchor;

a second anchor pivotably secured to said second side wall and pivoting from said second side wall to a position below said bottom wall for preventing rotation of said container relative to the ground surface;

said second anchor including a first pivot arm and a second pivot arm;

a second plate extending between said first pivot arm and said second pivot arm of said second anchor for engaging the soil layer;

a second locking arm extending between said second side wall and said second anchor for locking said second anchor relative to said second side wall;

said second anchor pivots between a storage position to an anchoring position;

said storage position defining a zero degree angle between said second side and said second anchor; and said anchoring position defining a greater than ninety degree angle between said second side and said second anchor.

14. A thermally insulated container for maintaining thermo energy of an object, the thermally insulated container positioned over a ground surface, the ground surface covering a soil layer, the thermally insulated container, comprising:

a bottom wall, a first side wall, a second side wall, a third side wall and a fourth side wall for defining a container;

said container defining a cavity for housing the object and an aperture for positioning the object within said cavity;

a cover plate engaging said aperture for covering said cavity;

a first anchor pivotably secured to said first side wall and pivoting from said first side wall to a position below said bottom wall for preventing rotation of said container relative to the ground surface;

said first anchor including a first pivot arm and a second pivot arm;

a first plate extending between said first pivot arm and said second pivot arm for engaging the soil layer;

a first locking arm extending between said first side wall and said first anchor for locking said first anchor relative to said first side wall;

said first side wall including a first anchor recess for housing said first anchor within said first side wall;

said first side wall including a first locking arm recess for housing said first locking arm within said first side wall;

a second anchor pivotably secured to said second side wall and pivoting from said second side wall to a position below said bottom wall for preventing rotation of said container relative to the ground surface;

said second anchor including a first pivot arm and a second pivot arm;

a second plate extending between said first pivot arm and said second pivot arm of said second anchor for engaging the soil layer;

a second locking arm extending between said second side wall and said second anchor for locking said second anchor relative to said second side wall;

said second side wall including a second anchor recess for housing said second anchor within said second side wall; and said second side wall including a second locking arm recess for housing said second locking arm within said second side wall.

15. A thermally insulated container for maintaining thermo energy of an object, the thermally insulated container positioned over a ground surface, the ground surface covering a soil layer, the thermally insulated container, comprising:

a bottom wall, a first side wall, a second side wall, a third side wall and a fourth side wall for defining a container;

said container defining a cavity for housing the object and an aperture for positioning the object within said cavity;

a cover plate engaging said aperture for covering said cavity;

a first anchor pivotably secured to said first side wall and pivoting at least ninety degrees from said first side wall for preventing rotation of said container relative to the ground surface;

said first anchor including a first pivot arm and a second pivot arm;

a first plate extending between said first pivot arm and said second pivot arm for increasing the surface area of said first anchor;

a first locking arm extending between said first side wall and said first anchor for locking said first anchor relative to said first side wall;

a second anchor pivotably secured to said second side wall and pivoting at least ninety degrees from said second side wall for preventing rotation of said container relative to the ground surface;

said second anchor including a first pivot arm and a second pivot arm;

a second plate extending between said first pivot arm and said second pivot arm of said second anchor for increasing the surface area of said second anchor; and a second locking arm extending between said second side wall and said second anchor for locking said second anchor relative to said second side wall.

* * * * *